US010332336B1

(12) United States Patent
Halvorson

(10) Patent No.: US 10,332,336 B1
(45) Date of Patent: Jun. 25, 2019

(54) GAMING SYSTEM AND METHOD HAVING AWARD ENHANCEMENTS BASED ON TEMPORARY AWARD OPPORTUNITY ACCUMULATIONS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/020,004

(22) Filed: Jun. 27, 2018

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/34* (2013.01)

(58) Field of Classification Search
CPC ... G07F 17/3213; G07F 17/3244; G07F 17/34
See application file for complete search history.

(56) References Cited

U.S. PATENT DOCUMENTS 5,833,537 A 11/1998 Barrie
6,186,894 B1 2/2001 Mayeroff
7,794,320 B2 9/2010 Baerlocher et al.
7,846,018 B2 * 12/2010 Baerlocher ..... G07F 17/3244 463/20
8,337,300 B2 12/2012 Bowers et al.
8,491,375 B2 7/2013 Low
8,585,485 B2 11/2013 Guinn
9,230,409 B2 1/2016 Pawloski
9,928,691 B2 3/2018 Olive
2002/0043759 A1 * 4/2002 Vancura ..... A63F 9/183 273/139
2002/0045474 A1 * 4/2002 Singer ..... G07F 17/32 463/20
2004/0048646 A1 3/2004 Visocnik
2004/0053673 A1 * 3/2004 Mishra ..... G07F 17/3244 463/20
2008/0045302 A1 2/2008 Low
2008/0248865 A1 * 10/2008 Tedesco ..... G07F 17/3248 463/25
2009/0221353 A1 9/2009 Joung
2010/0029381 A1 2/2010 Vancura
2010/0120489 A1 5/2010 Meyer
2010/0190542 A1 7/2010 Mizue
2010/0197377 A1 8/2010 Aoki et al.
(Continued)

FOREIGN PATENT DOCUMENTS

AU 2014903132 8/2014
AU 2015210489 A1 2/2016
(Continued)

*Primary Examiner* — Werner G Garner
(74) *Attorney, Agent, or Firm* — Resolute Legal PLLC

(57) ABSTRACT

Various embodiments of a gaming system and method are disclosed as having award enhancements based on one or more temporary award opportunity accumulations. The gaming system may evaluate accumulated temporary award opportunity indicators in association with generated symbols and symbol display areas in a play of a game to determine whether to provide an award or provide the award with an enhancement.

20 Claims, 10 Drawing Sheets

(56) References Cited

U.S. PATENT DOCUMENTS

| | | | |
|---|---|---|---|
| 2011/0003627 | A1 | 1/2011 | Nicely et al. |
| 2011/0117989 | A1 | 5/2011 | Kennedy et al. |
| 2011/0136565 | A1 | 6/2011 | Low |
| 2012/0231868 | A1 | 9/2012 | Guinn |
| 2012/0292588 | A1 | 11/2012 | Watkins et al. |
| 2014/0018146 | A1 | 1/2014 | Zielinski et al. |
| 2014/0087821 | A1 | 3/2014 | Zoltewicz et al. |
| 2014/0087860 | A1 | 3/2014 | Basallo et al. |
| 2014/0087861 | A1 | 3/2014 | Basallo et al. |
| 2014/0309010 | A1 | 10/2014 | Pawloski |
| 2015/0080096 | A1 | 3/2015 | Saunders et al. |
| 2015/0141114 | A1 | 5/2015 | Davis et al. |
| 2015/0248810 | A1 | 9/2015 | Wortmann et al. |
| 2016/0042597 | A1 | 2/2016 | Olive |
| 2016/0253873 | A1 | 9/2016 | Olive |
| 2017/0032610 | A1 | 2/2017 | Loz et al. |
| 2017/0154498 | A1 | 6/2017 | Olive |
| 2018/0082535 | A1 | 3/2018 | Filipour et al. |
| 2018/0082546 | A1 | 3/2018 | Mariscal et al. |
| 2018/0218572 | A1 | 8/2018 | Caputo |
| 2018/0225914 | A1 | 8/2018 | Heenan et al. |
| 2018/0261045 | A1 | 9/2018 | Takahara et al. |
| 2018/0268655 | A1 | 9/2018 | Olive |

FOREIGN PATENT DOCUMENTS

| | | | |
|---|---|---|---|
| AU | 2016900462 | | 2/2016 |
| AU | 2016100230 | A4 | 3/2016 |
| AU | 2016202727 | A1 | 5/2016 |
| AU | 2016101967 | A4 | 12/2016 |
| AU | 2017200840 | A1 | 3/2017 |
| AU | 2017204560 | A1 | 7/2017 |
| AU | 2017101097 | A4 | 9/2017 |
| AU | 2017101098 | A4 | 9/2017 |
| AU | 2017101629 | A4 | 12/2017 |
| AU | 2017101730 | A4 | 1/2018 |
| AU | 2017101731 | A4 | 1/2018 |

* cited by examiner

GAMING SYSTEM AND METHOD HAVING AWARD ENHANCEMENTS BASED ON TEMPORARY AWARD OPPORTUNITY ACCUMULATIONS

FIELD OF THE INVENTION

The present disclosure relates to gaming devices.

BACKGROUND OF THE INVENTION

Gaming machines that accept wagers in exchange for the opportunity to win awards or prizes are known. Game machines that offer new ways to win awards or prizes are needed to gain and retain players' interest in the gaming machines.

SUMMARY OF THE INVENTION

Various embodiments of a gaming system and method are disclosed as having award enhancements based on one or more temporary award opportunity accumulations. The gaming system may evaluate accumulated temporary award opportunity indicators in association with generated symbols and symbol display areas in a play of a game to determine whether to provide an award or provide the award with an enhancement.

Various embodiments of a gaming system and method are disclosed as having temporary award opportunity indicators associated with symbols and symbol display areas that persist through a plurality of plays of a game. In some embodiments, for a play of a game, the gaming system may generate an award opportunity indicator associated with both a symbol display area and a symbol displayed in the symbol display area. In some embodiments, the gaming system determines the award opportunity indicator based on an association between a generated lock-in symbol, the symbol display area, and the symbol displayed in the symbol display area. The gaming system may accumulate (e.g., store and hold) the award opportunity indicator so that it is available in at least a next play of the game. In some embodiments, the gaming system uses the award opportunity indicator in the next play of the game to determine an award or an award enhancement if the gaming system also randomly generates a same symbol in the symbol display area associated with the award opportunity indicator. In some embodiments, the gaming system permits the award opportunity indicator to be associated with the symbol display area for a determined quantity of additional plays of the game. It should be appreciated that for a play of the game, the gaming system may generate an award opportunity indicator for a plurality of the symbol display areas or for each symbol display area.

In some embodiments, the gaming system may generate at least one additional award opportunity indicator associated with the same symbol display area and a second symbol. Thus, in some such embodiments, the gaming system may accumulate a plurality of different award opportunity indicators for a same symbol display area for plays of the game. The plurality of different award opportunity indicators may be associated with different symbols. The plurality of different award opportunity indicators may be simultaneously associated with the same symbol display area during a same play of the game. In some embodiments, over a plurality of plays of the game, the gaming system may accumulate more than two award opportunity indicators for one or more of the symbol display areas.

In some embodiments, the gaming system may randomly generate a plurality of game symbols for a game set of symbol display areas and a plurality of lock-in symbols for a lock-in set of symbol display areas, where the lock-in set of symbol display areas are associated with the game set of symbol display areas. The gaming system displays, on a display device, the generated plurality of game symbols in the game set of symbol display areas and the generated plurality of lock-in symbols in the lock-in set of symbol display areas. The gaming system determines if any of the generated plurality of game symbols is a match with any of the generated plurality of lock-in symbols. If the gaming system determines that a match exists between a generated game symbol and a lock-in symbol, the gaming system generates an award opportunity indicator for the symbol display area that displays the matching game symbol, wherein the award opportunity indicator is also associated with the matching game symbol. In some embodiments, the gaming system may generate a similar award opportunity indicator for each symbol display area of the game set of symbol display areas and an associated generated game symbol. The generated award opportunity indicator may remain in association with the symbol display area for a predetermined quantity of additional plays of the game (e.g., five plays of the game or some other suitable number). The gaming system may also evaluate and issue any awards associated with winning symbol combinations based on the generated plurality of game symbols.

For a next play of the game (with the award opportunity indicator still associated with the symbol display area), the gaming system randomly generates and displays a plurality of replacement game symbols for the game set of symbol display areas. In some embodiments, the gaming system may remove the plurality of game symbols from the game set of symbol display areas. The gaming system may evaluate any awards associated with winning symbol combinations based on the generated plurality of replacement game symbols. The gaming system may also determine if a replacement game symbol displayed in the symbol display area associated with the award opportunity indicator is a match with the game symbol associated with the award opportunity indicator. The gaming system may determine any awards based on the replacement game symbol being displayed in the symbol display area associated with the award opportunity indicator and the match between the replacement game symbol and the game symbol associated with the award opportunity indicator. In some embodiments, an award based on the match between the replacement game symbol and the game symbol associated with the award opportunity indicator is an enhancement to the awards associated with winning symbol combinations based on the generated plurality of replacement game symbols. The gaming system may display, on the display device, any determined awards. The gaming system may increase the credit balance by any determined awards. The gaming system may enable a player to continue playing additional plays of the game and obtain additional awards based on the new replacement game symbols being generated in the symbol display area with the award opportunity indicator and matches between the new replacement game symbols and the game symbol associated with the award opportunity indicator.

In some embodiments, the gaming system may enable a second similar game (similar to the first game discussed above) to be played alongside the first game. For example, in some embodiments, the gaming system may randomly generate a second plurality of game symbols for a second game set of symbol display areas and a second plurality of lock-in symbols for a second lock-in set of symbol display areas, where the second lock-in set of symbol display areas are associated with the second game set of symbol display areas. In some embodiments, the randomly generated second plurality of game symbols and second plurality of lock-in symbols are generated along with the randomly generated plurality of game symbols and plurality of lock-in symbols. The gaming system may perform the same aforementioned actions for the randomly generated second plurality of game symbols and second plurality of lock-in symbols to determine award opportunity indicators. In addition, the gaming system may evaluate and issue any awards associated with winning symbol combinations based on a combination of the generated plurality of game symbols and the generated second plurality of game symbols. In some embodiments, the awards associated with winning symbol combinations based on a combination of the generated plurality of game symbols and the generated second plurality of game symbols is contingent on the gaming system generating a triggering condition (e.g., one or more symbols) or contingent on the player placing an additional wager.

By enabling the player to accumulate temporary award opportunities for future plays of a game and combining these accumulated temporary award opportunities with standard awards, the gaming system offers players new ways to obtain game awards and enhances players' excitement for a game. Moreover, by combining a first accumulating temporary award opportunity game with a second accumulating temporary award opportunity game, the gaming system offers players even greater new ways to obtain game awards. The new potential to improve or earn greater awards creates a greatly improved sense of anticipation for players.

DETAILED DESCRIPTION OF THE INVENTION

Figure 1:
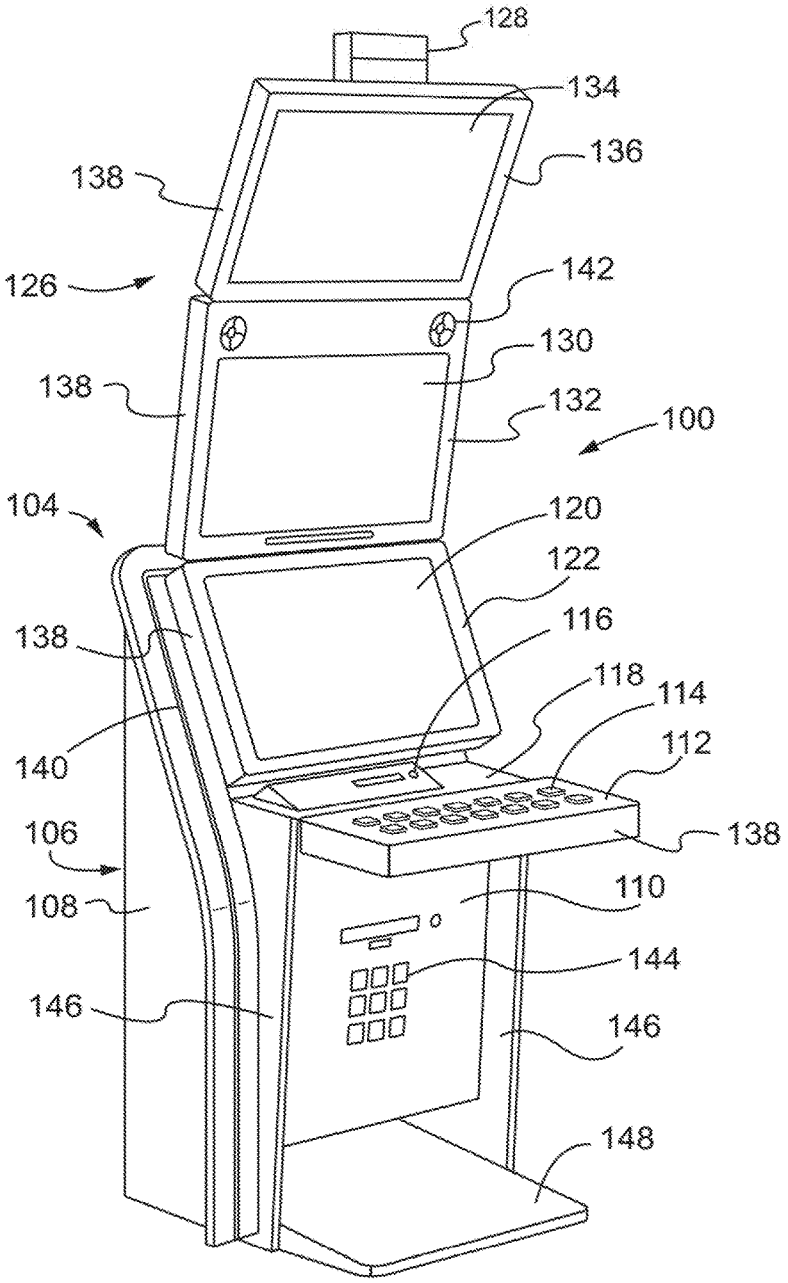
FIG. 1 is a perspective view of one embodiment of a stand-alone gaming device of a gaming system.

Various embodiments of a gaming system and method are disclosed as having award enhancements based on one or more temporary award opportunity accumulations. The gaming system may evaluate accumulated temporary award opportunity indicators in association with generated symbols and symbol display areas in a play of a game to determine whether to provide an award or provide the award with an enhancement.

Various embodiments of a gaming system and method are disclosed as having temporary award opportunity indicators associated with symbols and symbol display areas that persist through a plurality of plays of a game. In some embodiments, for a play of a game, the gaming system may generate an award opportunity indicator associated with both a symbol display area and a symbol displayed in the symbol display area. In some embodiments, the gaming system determines the award opportunity indicator based on an association between a generated lock-in symbol, the symbol display area, and the symbol displayed in the symbol display area. The gaming system may accumulate (e.g., store and hold) the award opportunity indicator so that it is available in at least a next play of the game. In some embodiments, the gaming system uses the award opportunity indicator in the next play of the game to determine an award or an award enhancement if the gaming system also randomly generates a same symbol in the symbol display area associated with the award opportunity indicator. In some embodiments, the gaming system permits the award opportunity indicator to be associated with the symbol display area for a determined quantity of additional plays of the game. It should be appreciated that for a play of the game, the gaming system may generate an award opportunity indicator for a plurality of the symbol display areas or for each symbol display area.

In some embodiments, the gaming system may generate at least one additional award opportunity indicator associated with the same symbol display area and a second symbol. Thus, in some such embodiments, the gaming system may accumulate a plurality of different award opportunity indicators for a same symbol display area for plays of the game. The plurality of different award opportunity indicators may be associated with different symbols. The plurality of different award opportunity indicators may be simultaneously associated with the same symbol display area during a same play of the game. In some embodiments, over a plurality of plays of the game, the gaming system may accumulate more than two award opportunity indicators for one or more of the symbol display areas.

In some embodiments, the gaming system may randomly generate a plurality of game symbols for a game set of symbol display areas and a plurality of lock-in symbols for a lock-in set of symbol display areas, where the lock-in set of symbol display areas are associated with the game set of symbol display areas. The gaming system displays, on a display device, the generated plurality of game symbols in the game set of symbol display areas and the generated plurality of lock-in symbols in the lock-in set of symbol display areas. The gaming system determines if any of the generated plurality of game symbols is a match with any of the generated plurality of lock-in symbols. If the gaming system determines that a match exists between a generated game symbol and a lock-in symbol, the gaming system generates an award opportunity indicator for the symbol display area that displays the matching game symbol, wherein the award opportunity indicator is also associated with the matching game symbol. In some embodiments, the gaming system may generate a similar award opportunity indicator for each symbol display area of the game set of symbol display areas and an associated generated game symbol. The generated award opportunity indicator may remain in association with the symbol display area for a predetermined quantity of additional plays of the game (e.g., five plays of the game or some other suitable number). The gaming system may also evaluate and issue any awards associated with winning symbol combinations based on the generated plurality of game symbols.

For a next play of the game (with the award opportunity indicator still associated with the symbol display area), the gaming system randomly generates and displays a plurality of replacement game symbols for the game set of symbol display areas. In some embodiments, the gaming system may remove the plurality of game symbols from the game set of symbol display areas. The gaming system may evaluate any awards associated with winning symbol combinations based on the generated plurality of replacement game symbols. The gaming system may also determine if a replacement game symbol displayed in the symbol display area associated with the award opportunity indicator is a match with the game symbol associated with the award opportunity indicator. The gaming system may determine any awards based on the replacement game symbol being displayed in the symbol display area associated with the award opportunity indicator and the match between the replacement game symbol and the game symbol associated with the award opportunity indicator. In some embodiments, an award based on the match between the replacement game symbol and the game symbol associated with the award opportunity indicator is an enhancement to the awards associated with winning symbol combinations based on the generated plurality of replacement game symbols. The gaming system may display, on the display device, any determined awards. The gaming system may increase the credit balance by any determined awards. The gaming system may enable a player to continue playing additional plays of the game and obtain additional awards based on the new replacement game symbols being generated in the symbol display area with the award opportunity indicator and matches between the new replacement game symbols and the game symbol associated with the award opportunity indicator.

In some embodiments, the gaming system may enable a second similar game (similar to the first game discussed above) to be played alongside the first game. For example, in some embodiments, the gaming system may randomly generate a second plurality of game symbols for a second game set of symbol display areas and a second plurality of lock-in symbols for a second lock-in set of symbol display areas, where the second lock-in set of symbol display areas are associated with the second game set of symbol display areas. In some embodiments, the randomly generated second plurality of game symbols and second plurality of lock-in symbols are generated along with the randomly generated plurality of game symbols and plurality of lock-in symbols. The gaming system may perform the same aforementioned actions for the randomly generated second plurality of game symbols and second plurality of lock-in symbols to determine award opportunity indicators. In addition, the gaming system may evaluate and issue any awards associated with winning symbol combinations based on a combination of the generated plurality of game symbols and the generated second plurality of game symbols. In some embodiments, the awards associated with winning symbol combinations based on a combination of the generated plurality of game symbols and the generated second plurality of game symbols is contingent on the gaming system generating a triggering condition (e.g., one or more symbols) or contingent on the player placing an additional wager.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
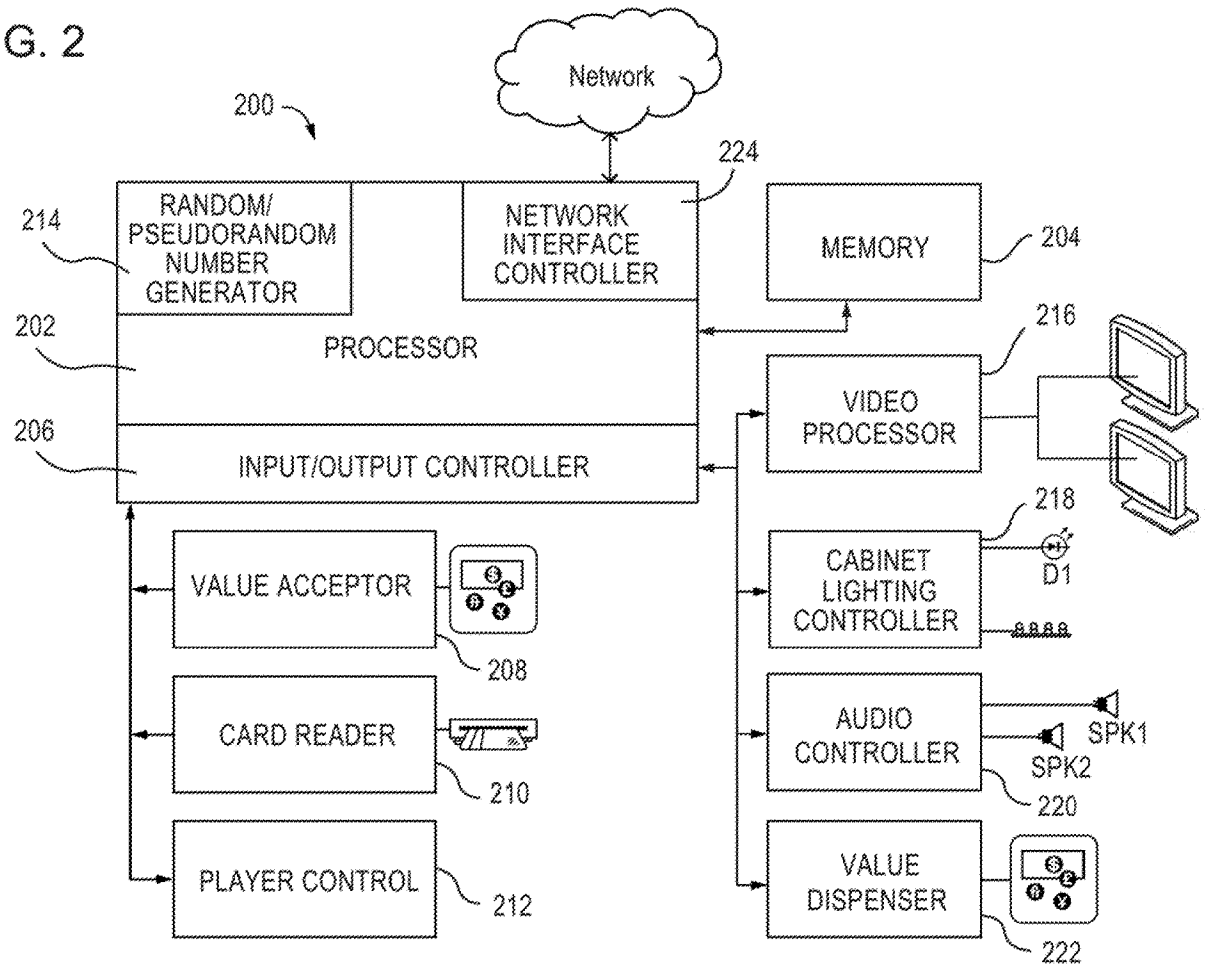
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202. In some embodiments, the random number generator may be located in a central server or a server that is remote from the gaming device 100. The gaming device 100 may receive the randomly generated values from the central server or remote server.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
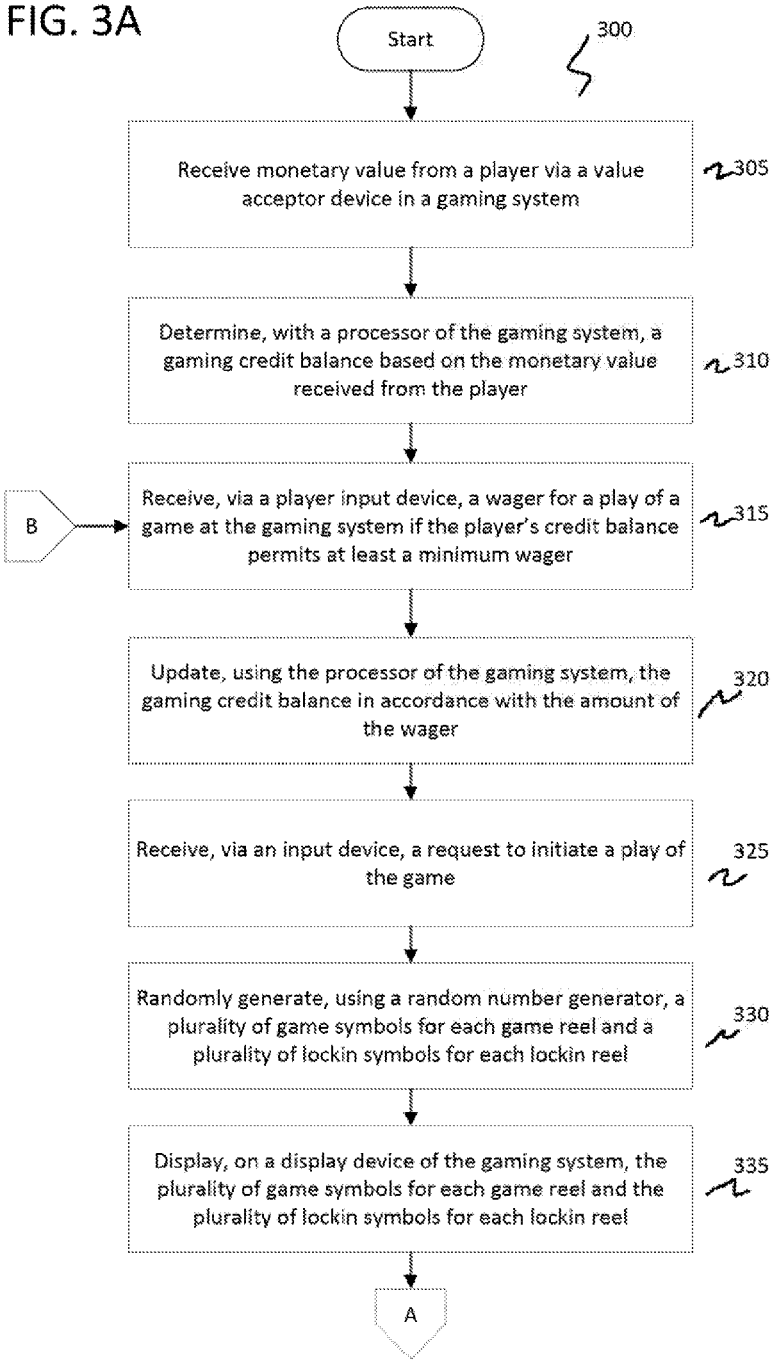
FIGS. 3A and 3B illustrate one embodiment of a method of operating the gaming system having award enhancements based on one or more temporary award opportunity accumulations.
Figure 3B:
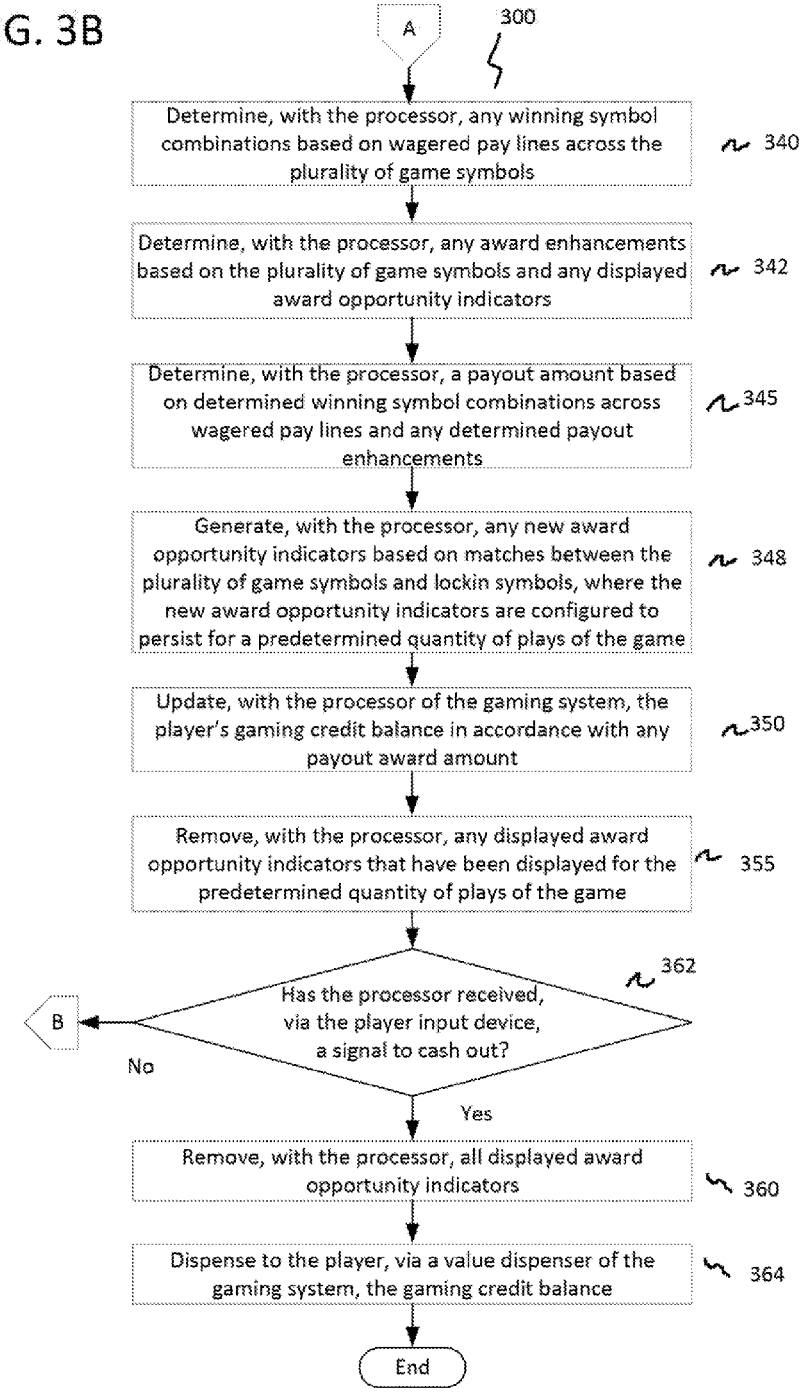

FIGS. 3A and 3B illustrate a flowchart of an example operation 300 of one embodiment of the gaming system and method. FIGS. 3A and 3B are depicted as a base or primary. However, it should be appreciated that FIGS. 3A and 3B may be integrated as part of a bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols from a plurality of sets of symbols as indicated in block 330. In one embodiment, the gaming system randomly generates a plurality of game symbols for each game reel and a plurality of lock-in symbols for each lock-in reel. In some embodiments, the gaming system may generate the plurality of symbols for display on a set of reels (or virtual reels). In some such embodiments, each reel is associated with its own set of symbols. As used herein, the random number generation may refer to pseudo-random or true-random number generation depending on the module used for the random number generation.

In one embodiment, the gaming system causes a display device of the gaming system to display the plurality of symbols generated as indicated in block 335. In a game using reels, the gaming system may display the generated plurality of game symbols in visible symbol display areas of each of the game reels. In some embodiments, the gaming system has one set of game reels, including a plurality of game reels. In alternative embodiments, the gaming system includes at least two different sets of game reels, where each set includes a plurality of game reels. For example, the gaming system may include a first set of game reels that generate a first type of symbols and a second set of game reels that generate a second type of symbols. The gaming system also displays the generated plurality of lock-in symbols in visible symbol display areas of each of the lock-in reels. In an embodiment with one set of game reels, the gaming system may generate one lock-in reel that corresponds to the one set of game reels. However, it should be appreciated that the gaming system may generate any suitable number of lock-in reels. In an embodiment with two sets of game reels, the gaming system may generate one lock-in reel for each of the sets of game reels. For example, the first set of game reels is associated with a first lock-in reel while the second set of game reels is associated with a second lock-in reel. Off page connector A refers to FIG. 3B to continue operation 300.

Turning now to FIG. 3B and off page connector A, in one embodiment, as shown in block 340, the gaming system evaluates the plurality of game symbols and determines, with the processor, the existence of any winning symbol combinations based on the player's active or wagered pay lines across the generated plurality of game symbols. In some embodiments, the lock-in symbols on any lock-in reels, which are associated with the game symbols, are not used in the evaluation and determination of any winning symbol combinations of the game symbols.

In an embodiment with two sets of game reels, the gaming system may perform separate evaluations of the two sets of game reels to determine winning symbol combinations. Thus, in some embodiments, each of the game reel sets can be viewed as a separate game played at the same time within a play of the game. In some embodiments, the gaming system may evaluate both of the separate game reels sets together for winning symbol combinations that are different from winning symbol combinations used to evaluate each game set of reels separately.

In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated plurality of symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In block 342, the gaming system determines any additional awards or award enhancements based on the plurality of game symbols generated for the game reels and any displayed award opportunity indicators. Award opportunity indicators are associated with a particular game symbol and a symbol display position. For example, an award opportunity indicator can be associated with a cherry symbol and a top left most symbol display position of a plurality of the game reels. If such an award opportunity indicator is associated with the cherry symbol and the top left most symbol display position of the plurality of the game reels, and the gaming system generated a cherry symbol in that top left most symbol display position, then the gaming system may award an additional award or an award enhancement. The additional award or award enhancement can be credits, a credit multiplier, or some other suitable award. The additional awards or award enhancements may be defined in a pay table or randomly generated from a set of awards. In some embodiments, for an initial play of a game, the gaming system may not have generated any award opportunity indicators. Thus, at block 342, for an initial play of the game, the gaming system may determine that no any additional awards or award enhancements are available. However, in some embodiments, the gaming system may provide the player with one or more initial award opportunity indicators. In other embodiments, the gaming system may enable the player to purchase or place a wager to obtain one or more award opportunity indicators.

In block 345, the gaming system determines, with the processor, a payout amount based on the evaluated winning symbol combinations across wagered pay lines. In some embodiments, the payout amount may be increased or otherwise enhanced based on any determined payout enhancements (e.g., in accordance with the additional award or award enhancements discussed in connection with block 342).

At block 348, the gaming system generates with the processor, new award opportunity indicators based on matches between the generated plurality of game symbols and lock-in symbols, where the new award opportunity indicators are configured to persist for a predetermined quantity of plays of the game. In one embodiment, rows of a lock-in reel are aligned with rows of the set of game reels. The gaming system may generate symbols for the lock-in reels that are the same as symbols generated for the set of game reels. In such an embodiment, the gaming system compares a generated lock-in symbol in a particular row with symbols generated for the set of game reels in the same row. If the gaming system determines that a generated lock-in symbol matches with a game symbol in the same row of both reels, the gaming system may generate an award opportunity indicator for a symbol display position in the game reel that displays the matching game symbol in some embodiments. The gaming system also stores and association between the award opportunity indicator with the matching game symbol. In one embodiment, the gaming system generates the award opportunity indicator as a visual indicator in the symbol display position. The award opportunity indicator may highlight the symbol display position as will be discussed below in greater detail. The award opportunity indicator may be displayed apart from the symbol display position in some embodiments. The award opportunity indicator is generally used in a next play of the game (or a next spin of the reels) to determine additional awards or award enhancements as discussed in connection with block 342. In some embodiments, to use the award opportunity indicator, in the next play of the game, the gaming system must generate a symbol in the same symbol display area with the award opportunity indicator, where the symbol matches the symbol that was associated with the award opportunity indicator. In some embodiments, the gaming system may generate the award opportunity indicator for each symbol and symbol display position on the game reels that matches with lock-in symbols in the lock-in reel.

In some embodiments, a newly generated award opportunity indicator will stay associated with its symbol and symbol display area for a predetermined quantity of next plays of the game (e.g., next spins of the reels). In some embodiments, the predetermined quantity of next plays of the game (e.g., next spins of the reels) is three games. In other embodiments, the predetermined quantity is five games. Any suitable number can be used for the predetermined quantity of games. It should be appreciated that in some embodiments, the predetermined quantity can be randomly generated.

In some embodiments, the gaming system can generate more than one award opportunity indicator for one symbol display area. As the player plays multiple plays of the game, the gaming system may generate a first award opportunity indicator and then generate additional award opportunity indicators in one symbol display area for different symbols. In some embodiments, the gaming system may determine that a generated lock-in symbol matches with a game symbol in the same row of both reels, but an award opportunity indicator already exists in the same symbol display area for the same symbol. In some such embodiments, the gaming system may ignore such a match because an award opportunity indicator already exists for the symbol in the particular symbol display area. In alternative embodiments, the gaming system may increase the quantity of games that the existing award opportunity indicator will remain displayed based on the new predetermined quantity games (i.e., the gaming system may sum the quantity of games for the existing count of games remaining with the new count of games).

In some embodiments, the gaming system creates a counter for each award opportunity indicator to determine how many more plays of the game the award opportunity indicator will be available to enhance awards. As the gaming system executes games, the gaming system alters each counter for each award opportunity indicator to track when the award opportunity indicators should be removed for a next play of a game.

In some embodiments, the gaming system may not generate new award opportunity indicators if matches between the generated plurality of game symbols and lock-in symbols are not found.

As illustrated in block 350, the gaming system may update, with the processor, the player's gaming credit balance in accordance with any award amount (including any additional award or award enhancement). As noted above, the blocks illustrated in FIGS. 3A and 3B can be rearranged in any suitable order. As such, it should be appreciated that the gaming system may update the player's gaming credit balance at other suitable times.

At block 355, the gaming system removes with the processor, any displayed award opportunity indicators that have been displayed for the predetermined quantity of plays of the game. It should be appreciated that in some embodiments, the gaming system may decrement each counter for each displayed award opportunity indicator that was not generated during the current play of the game (not shown). That is, for a play of a game, the gaming system may not alter a counter for newly generated award opportunity indicators, but will alter counters for award opportunity indicators that persisted from a prior play of the game.

In some embodiments, the gaming system may also evaluate the plurality of symbols across wagered pay lines for symbol combinations that trigger a bonus game with a predetermined quantity of spins (or activations, where the bonus game does not use slot reels). In some embodiments the symbol or symbol combinations that trigger the bonus game do not need to appear on wagered pay lines. In some embodiments, the predetermined quantity of spins are provided as free spins. In other embodiments, the player may pay to obtain the predetermined quantity of spins. It should also be appreciated that in some embodiments, events other than generating one or more of a predetermined symbol may trigger the bonus game. In one embodiment, if the gaming system determines that the generated plurality of symbols includes one or more generated predetermined symbols, the gaming system will trigger or activate the bonus game. The gaming system may execute the bonus game and return to block 362. The bonus game may be any suitable game. The bonus game may be similar to the game described herein and may be played with free spins or other altered features.

If the gaming system determined that the generated plurality of symbols did not result in triggering a bonus game or the gaming system completed execution of a bonus game, operation 300 moves to block 362. In one embodiment, as indicated in block 362, the gaming system may receive a signal to end game play or "cash out" via an input device of the gaming system.

In some embodiments, the gaming system removes all displayed award opportunity indicators when the player ends all game play or cashes out, as illustrated in block 360. By removing all displayed award opportunity indicators, the gaming system provides a number of benefits. One benefit is that the gaming system uses less memory and reduces the processor load because the award opportunity indicators are removed earlier than was possible if the player continued to play additional games. Using less memory and less processing power reduces the gaming system's power usage, making the gaming system more efficient. Another benefit is that the award opportunity indicators are not left for a next player that uses the gaming system (the next player must attempt to accumulate new award opportunity indicators for the next player's gaming session). By not having left over award opportunity indicators for a next player, other players are less likely to fight over a gaming system that has persistent award opportunity indicators from a prior player. However, it should be appreciated that the gaming system can be configured to permit the award opportunity indicators to remain after a player ends game play or cashes out, in alternative embodiments.

As illustrated in block 364, the gaming system dispenses a value to the player, through a value dispenser, based on the player's gaming credit balance and operation 300 ends.

Returning to block 362, if the gaming system has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

In some embodiments, the gaming system can generate an award opportunity indicator for any game symbol generated for the game reels and for any symbol display area of the game reels. Thus, in some embodiments, the gaming system can generate an award opportunity indicator for a game symbol such as a bonus triggering symbol. In some embodiments, when the gaming system generates an award opportunity indicator associated with a bonus triggering symbol, the gaming system may evaluate an active award opportunity indicator as one or more extra triggering symbols to trigger a bonus game. In some embodiments, when the gaming system generates a bonus triggering symbol in a symbol display area associated with an award opportunity indicator (associated with the bonus triggering symbol), the gaming system may evaluate that event as a bonus triggering event.

In some embodiments, award opportunity indicators are provided as part of a standard wager in a game. In alternative embodiments, award opportunity indicators are not free. For example, in some embodiments, a player must wager at a predetermined minimum level before the gaming system makes the award opportunity indicators available during a play of the game. In some embodiments, once the player obtains an award opportunity indicator, the award opportunity indicator may persist for additional plays of the game without maintaining the predetermined minimum wager level. In alternative embodiments, the player must continue to wager at the predetermined minimum level for each play of the game to maintain the persistence of any accumulated award opportunity indicators for additional plays of the game. In some embodiments, when the player has not wagered the predetermined minimum level, the gaming system may still generate and display award opportunity indicators, but the gaming system may not evaluate the award opportunity indicators to determine award enhancements.

In some embodiments, the gaming system includes a second set of game reels and a second lock-in reel. In some embodiments, a player must wager at a predetermined minimum level before the gaming system makes the second set of game reels and the second lock-in reel available for the player during a play of the game. In some embodiments, when the player has not wagered the predetermined minimum level, the gaming system may still generate and display game symbols for the second set of game reels and lock-in symbols for the second lock-in reel (as well as award opportunity indicators for the second set of game reels), but the gaming system may not evaluate the generated symbols for the second set of game reels for awards (or award opportunity indicators on the second set of game reels to determine award enhancements).

In some embodiments including more than one set of game reels, the gaming system evaluates each set of the game reels in different directions. For example, the gaming system may evaluate a first set of game reels from right to left, while the gaming system evaluates a second set of game reels from left to right. In some embodiments, the gaming system may evaluate generated symbols for two or more of the sets of game reels together for winning symbol combinations. In some such embodiments, each set of game reels may be associated with its own pay table for evaluating winning symbol combinations, while the gaming system may be configured to evaluate the combined sets of game reels with another pay table that accounts for certain winning symbol combinations form across the combined sets of game reels.

In some embodiments including more than one set of game reels, the gaming system uses the same symbols for the sets of game reels. In alternative embodiments, one or more of the sets of game reels uses different symbols.

In some embodiments, a lock-in reel is positioned on the left side or the right side of the game reels. In embodiments with two different sets of game reels, where each set of game reels is associated with its own lock-in reel (or lock-in reels), the lock-in reels can be positioned in a center area between the two different sets of game reels.

In some embodiments including more than one set of game reels, all of the sets of game reels are associated with one lock-in reel.

In some embodiments, when the gaming system provides an additional award or an award enhancement associated with an award opportunity indicator, the gaming system thereafter removes the used award opportunity indicator so that the award opportunity indicator is not available for a next play of the game. In alternative embodiments, the award opportunity indicator can be used to provide an additional award or an award enhancement for a plurality of plays of a game (e.g., the award opportunity indicator can be used more than once).

In some embodiments, when the gaming system generates more than one award opportunity indicator in one symbol display area, the gaming system may use different colored boxes, halos, or other suitable highlighting around the one symbol display area to illustrate that more than one award opportunity indicator is associated with the one symbol display area. In some embodiments, the award opportunity indicators are also identified with a representation of an associated symbol. In some such embodiments, a generated award opportunity indicator may be displayed with a miniature version of the associated symbol. In some embodiments, the gaming system displays a separate key or legend on a display device to illustrate which symbol and symbol display area each displayed award opportunity indicator is associated with. In one embodiment where boxes, halos, or other suitable highlighting are used to indicate an award opportunity indicator and an award opportunity indicator persists for a predetermined quantity of plays of a game, the boxes, halos, or other suitable highlighting is initially displayed very bright and subsequently dims as the gaming system executes each predetermined quantity of plays of the game. The gaming system eventually renders the boxes, halos, or other suitable highlighting as not visible (or removed) once the predetermined quantity of plays of a game have passed for a given award opportunity indicator.

FIGS. 4A-4D illustrate screen shots of one embodiment of a gaming system having award enhancements based on temporary award opportunity accumulations. While FIGS. 4A-4D are described in terms of a base game, it should be appreciated that the features discussed in connection with FIGS. 4A-4D can be used in connection with a bonus game.

Figure 4A:
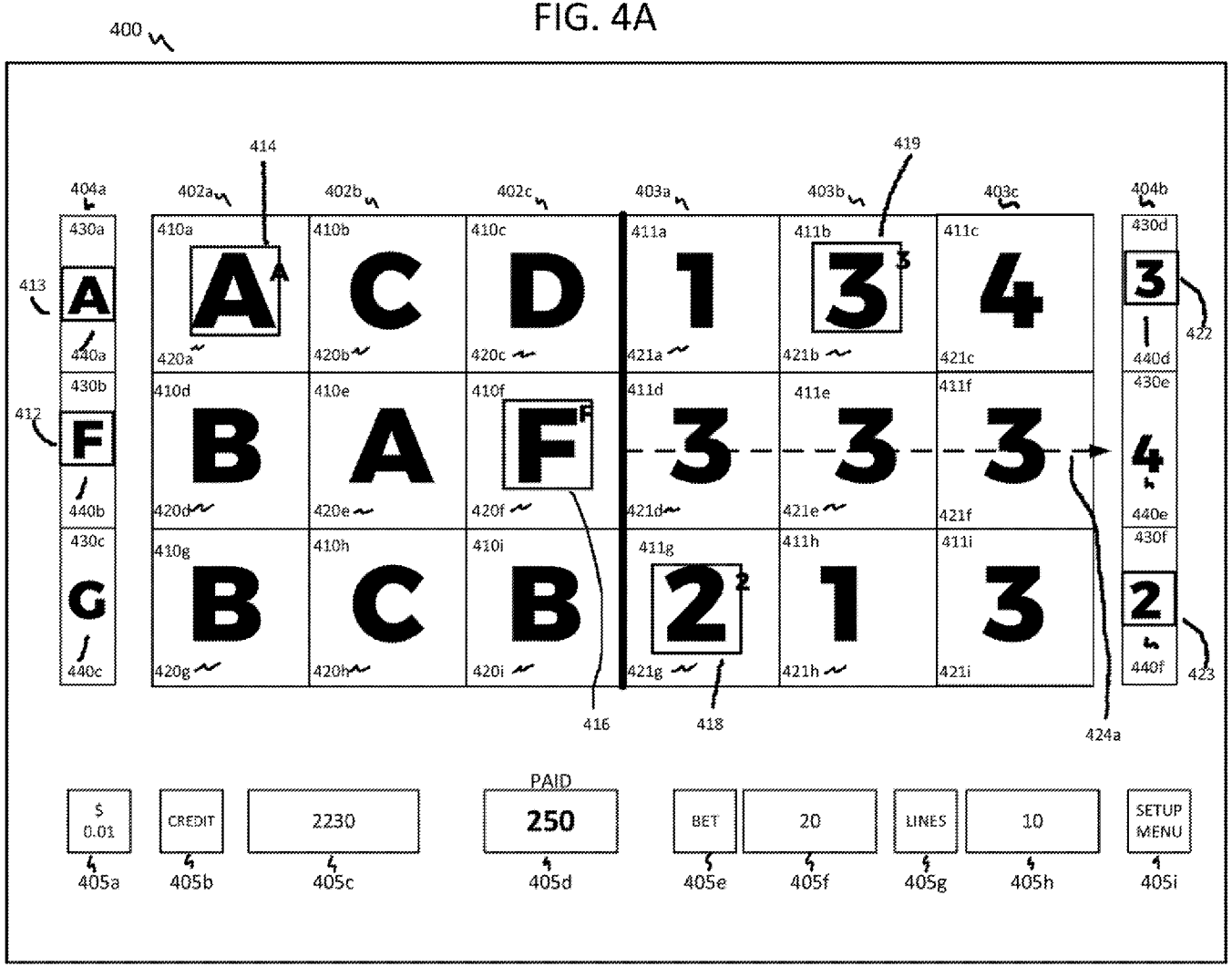
FIGS. 4A, 4B, 4C, and 4D illustrate screen shots of one embodiment of a gaming system having award enhancements based on one or more temporary award opportunity accumulations.

FIG. 4A illustrates one embodiment of a game display 400 that the gaming device 100 may display on a display device of the gaming system. In one embodiment, game display 400 may be displayed on first display 120 of gaming device 100 illustrated in FIG. 1. However, any other suitable display may be used. The game display 400 displays a first set of a plurality of virtual video slot machine reels 402*a*, 402*b*, and 402*c* (e.g., a first set of game reels) as illustrated in FIG. 4A for a primary or base game. As also illustrated in FIG. 4A, the reels 402*a*-402*c* are displayed substantially side by side. It should be appreciated that reels 402*a*-402*c* can be displayed with any suitable amount of separation or no separation. FIG. 4A illustrates a lock-in reel 404*a* displayed to the left of the reels 402*a*-402*c*. Lock-in reel 404*a* is associated with the reels 402*a*-402*c* as will be discussed below. Lock-in reel 404*a* can be displayed with any suitable amount of separation or no separation from reels 402*a*-402*c*. In some embodiments, lock-in reel 404*a* can be position to the right of reels 402*a*-402*c*. In some embodiments, reels 402*a*-402*c* are separated from reels 403*a*-403*c*, enabling lock-in reel 404*a* to be positioned between such reels 402*a*-402*c* and reels 403*a*-403*c*.

The game display 400 displays a second set of a plurality of virtual video slot machine reels 403*a*, 403*b*, and 403*c* (e.g., a second set of game reels) as illustrated in FIG. 4A for a primary or base game. As also illustrated in FIG. 4A, the reels 403*a*-403*c* are displayed substantially side by side. It should be appreciated that reels 403*a*-403*c* can be displayed with any suitable amount of separation or no separation. FIG. 4A illustrates a lock-in reel 404*b* displayed to the right of the reels 403*a*-403*c*. Lock-in reel 404*b* is associated with the reels 403*a*-403*c* as will be discussed below. Lock-in reel 404*b* can be displayed with any suitable amount of separation or no separation from reels 403*a*-403*c*. In some embodiments, lock-in reel 404*b* can be position to the left of reels 403*a*-403*c*. In some embodiments, reels 403*a*-403*c* are separated from reels 402*a*-402*c*, enabling lock-in reel 404*b* to be positioned between such reels 403*a*-403*c* and reels 402*a*-402*c*. In some embodiments, lock-in reels 404*a* and 404*b* can be positioned between both reels 403*a*-403*c* and reels 402*a*-402*c*.

It should be appreciated that the game shown in game display 400 is merely representative and may have more or fewer game elements (e.g., reels, symbol display areas, symbols, etc.) shown in the game display 400. It should also be appreciated that other games may be used for the primary or base game.

Each of the plurality of game reels 402*a*-402*c*; each of the plurality of game reels 403*a*-403*c*; the lock-in reel 404*a*; and the lock-in 404*b* are associated with their own set of symbols, where each set of symbols includes a plurality of symbols. Each set of symbols can be associated with the same or a different plurality of symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols. In one embodiment, at least one predetermined symbol is a triggering symbol for a bonus game. In one embodiment, at least one triggering symbol must be generated on the reels during a play of a game to trigger the bonus game. In some embodiments, a plurality of triggering symbols must be generated on the reels during a play of a game to trigger the bonus game. In one embodiment, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some embodiments.

In the embodiments illustrated in FIG. 4A-4D, the first set of game reels 402*a*-402*c* and lock-in reel 404*a* use the same symbols in their respective symbol sets while the second set of game reels 403*a*-403*c* and lock-in reel 404*b* use the same symbols in their respective symbol sets. As illustrated, in FIG. 4A-4D, the symbols used for the first set of game reels 402*a*-402*c* and lock-in reel 404*a* in their respective symbol sets are different from the symbols used for the the second set of game reels 403*a*-403*c* and lock-in reel 404*b* in their respective symbol sets. However, in alternative embodiments, the symbols can be the same between the different reel sets.

Returning now to FIG. 4A, the game display 400 depicts a plurality of symbol display areas (also referred to herein as symbol display positions) 410*a*, 410*b*, 410*c*, 410*d*, 410*e*, 410*f*, 410*g*, 410*h*, and 410*i*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, and 410*i* are associated in a manner that provides the appearance of a set of three game reels for a slot machine. In one embodiment, the plurality of symbol display areas that provide the appearance of three game reels may be arranged in a manner that visibly shows three symbol positions of each of the three game reels. For example, the symbol display areas 410*a*-410*i* are each associated with positions on reels 402*a*-402*c*, respectively. As shown in FIG. 4A, symbol display areas 410*a*, 410*d*, and 410*g* are associated with reel 402*a*; symbol display areas 410*b*, 410*e*, and 410*h* are associated with reel 402*b*; and symbol display areas 410*c*, 410*f*, and 410*i* are associated with reel 402*c*. The arrangement illustrated in the embodiment of FIG. 4A thus creates a visible display area of the reels 402*a*-402*c* comprising three visible symbol positions for each reel. When viewed together, reels 402*a*-402*c* appear like a 3-row by 3-column reel array in display 400. In other embodiments, smaller or larger visible areas of the reels can be displayed. That is, the reels 402*a*-402*c* may show fewer or a larger number of visible symbol display areas. Associated lock-in reel 404*a* also depicts a plurality of symbol display areas 430*a*, 430*b*, and 430*c*. The lock-in reel 404*a* is associated with symbol display areas 410*a*-410*i* because symbols generated on the lock-in reel 404*a* are evaluated together with symbols generated for symbol display areas 410*a*-410*i* to create award opportunity indicators. These plurality of symbol display areas can be associated in a manner that provides the appearance of a reel. It should also be appreciated that the symbol display areas may not be associated with reels in some embodiments. As illustrated in FIG. 4A, symbol display areas 430*a*, 430*b*, and 430*c* are associated in a manner that provides the appearance of one reel (a lock-in reel) for a slot machine. In one embodiment, the plurality of symbol display areas that provide the appearance of one reel may be arranged in a manner that visibly shows three symbol positions in the one reel. For example, the symbol display areas 430*a*-430*c* are each associated with positions on the reel 404*a*.

The game display 400 also depicts a plurality of symbol display areas (also referred to herein as symbol display positions) 411*a*, 411*b*, 411*c*, 411*d*, 411*e*, 411*f*, 411*g*, 411*h*, and 411*i*. These plurality of symbol display areas can be associated in a manner that provides the appearance of game reels. It should also be appreciated that the symbol display areas may not be associated with game reels in some embodiments. As illustrated in FIG. 4A, symbol display areas 411*a*, 411*b*, 411*c*, 411*d*, 411*e*, 411*f*, 411*g*, 411*h*, and 411*i* are associated in a manner that provides the appearance of a set of three game reels for a slot machine. In one embodiment, the plurality of symbol display areas that provide the appearance of three game reels may be arranged in a manner that visibly shows three symbol positions of each of the three game reels. For example, the symbol display areas 411*a*-411*i* are each associated with positions on reels 403*a*-403*c*, respectively. As shown in FIG. 4A, symbol display areas 411*a*, 411*d*, and 411*g* are associated with reel 403*a*; symbol display areas 411*b*, 411*e*, and 411*h* are associated with reel 403*b*; and symbol display areas 411*c*, 411*f*, and 411*i* are associated with reel 403*c*. The arrangement illustrated in the embodiment of FIG. 4A thus creates a visible display area of the reels 403*a*-403*c* comprising three visible symbol positions for each reel. When viewed together, reels 403*a*-403*c* appear like a 3-row by 3-column reel array in display 400. In other embodiments, smaller or larger visible areas of the reels can be displayed. That is, the reels 403*a*-403*c* may show fewer or a larger number of visible symbol display areas. Associated lock-in reel 404*b* also depicts a plurality of symbol display areas 430*d*, 430*e*, and 430*f* The lock-in reel 404*b* is associated with symbol display areas 411*a*-411*i* because symbols generated on the lock-in reel 404*b* are evaluated together with symbols generated for symbol display areas 411*a*-411*i* to create award opportunity indicators. These plurality of symbol display areas can be associated in a manner that provides the appearance of a reel. It should also be appreciated that the symbol display areas may not be associated with reels in some embodiments. As illustrated in FIG. 4A, symbol display areas 430*d*, 430*e*, and 430*f* are associated in a manner that provides the appearance of one reel (another lock-in reel) for a slot machine. In one embodiment, the plurality of symbol display areas that provide the appearance of one reel may be arranged in a manner that visibly shows three symbol positions in the one reel. For example, the symbol display areas 430*d*-430*f* are each associated with positions on the reel 404*b*.

While symbol display areas are illustrated with defined boxes in FIGS. 4A-4D, it should be appreciated that in some embodiments, the defined boxes are not visible to the player. It should also be appreciated that in some embodiments, the symbol display areas are other shapes or not defined shapes and may not be associated with reels.

Each set of game reels 402*a*-402*c* and 403*a*-403*c* and lock-in reels 404*a* and 404*b* may display a plurality of symbols that the gaming system generates from their respective sets of symbols in their respective symbol display areas as illustrated in FIG. 4A. In one embodiment, the reels may be shown spinning in one direction to simulate slot machine reels. However, it should be appreciated that the reels may be shown spinning in any suitable direction. The reels may also be shown spinning in different directions in some embodiments.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the end of one play of the game, the information area 405*d* shows 250 credits have been won (which will be explained further below). Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits by selecting to wager 20 credits on 10 pay lines. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*. As previously discussed, in some embodiments, the gaming system may require a predetermined wager threshold so that all of the game features (e.g., the second set of game reels, the lock-in reels, award opportunity indicators, award enhancements, and pay tables for each set of game reels separately and a pay table for the combined sets of game reels, etc.) are available for a play of the game. The predetermined wager threshold can be any suitable amount (e.g., 200 credits). In the illustrated FIGS. 4A-4D, the player placed a wager for each play of the game that is greater than or equal to the assigned predetermined wager, making all game features potentially available to the player for the plays of the game.

To initiate a play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels for each of the first set of game reels 402*a*-402*c*; the second set of game reels 403*a*-403*c*; and the lock-in reels 404*a* and 404*b*. The spinning (not shown) may appear to occur in a vertical top to bottom direction or in a vertical bottom to top direction, or in a combination of vertical directions. In one embodiment, the gaming system randomly generates symbols from the associated sets of symbols for the first set of game reels 402*a*-402*c*; the second set of game reels 403*a*-403*c*; and the lock-in reels 404*a* and 404*b*, respectively. As noted above, the gaming system may rely on random generation performed by a pseudo RNG, a true RNG, or hardware RNG specifically designed for gaming systems. In one embodiment, the gaming system may also update the player's credit meter (information area 405*c*) to reflect the player's available credit balance. While not shown in FIG. 4A, the player's credit meter (information area 405*c*) was decremented by 200 credits from 2180 to 1980 to reflect the 200 credit wager the player placed for the play of the game.

As illustrated in FIG. 4A, the gaming system displays the generated game symbols 420*a*-420*i* in the first set of symbol display areas 410*a*-410*i*. Symbols 420*a*-420*i* displayed on reels 402*a*-402*c* illustrate the randomly generated symbols from the associated sets of symbols after the reels have stopped spinning. As illustrated in FIG. 4A, the gaming system randomly generated and displayed game symbols 420*a*, 420*d*, and 420*g* in game symbol display areas 410*a*, 410*d*, and 410*g* for game reel 402*a*. The gaming system also randomly generated and displayed game symbols 420*b*, 420*e*, and 420*h* in game symbol display areas 410*b*, 410*e*, and 410*h* for game reel 402*b*; and game symbols 420*c*, 420*f*, and 420*i* in game symbol display areas 410*c*, 410*f*, and 410*i* for game reel 402*c*. As illustrated in FIG. 4A, the gaming system generated and displayed A symbols (420*a*, 420*e*), C symbols (420*b*, 420*h*), B symbols (420*f*, 420*g*, 420*i*), and a D symbol (420*c*) in the game display 400. It should be appreciated that the displayed symbol combinations are merely for explanatory purposes and the gaming system may randomly generate any suitable combination of symbols based on defined symbol sets associated with the game reels 402*a*-402*c*.

FIG. 4A also illustrates the gaming system displaying the generated game symbols 421*a*-421*i* in the second set of symbol display areas 411*a*-411*i*. Game symbols 421*a*-421*i* displayed on game reels 403*a*-403*c* illustrate the randomly generated symbols from the associated sets of symbols after the reels have stopped spinning. As illustrated in FIG. 4A, the gaming system randomly generated and displayed game symbols 421*a*, 421*d*, and 421*g* in game symbol display areas 411*a*, 411*d*, and 411*g* for game reel 403*a*. The gaming system also randomly generated and displayed game symbols 421*b*, 421*e*, and 421*h* in game symbol display areas 411*b*, 411*e*, and 411*h* for game reel 403*b*; and game symbols 421*c*, 421*f*, and 421*i* in game symbol display areas 411*c*, 411*f*, and 411*i* for game reel 403*c*. As illustrated in FIG. 4A, the gaming system generated and displayed 1 symbols (421*a*, 421*h*), 3 symbols (421*b*, 421*d*, 421*e*, 421*f*, 421*i*), a 4 symbol (421*c*), and a 2 symbol (421*g*) in the game display 400. It should be appreciated that the displayed symbol combinations are merely for explanatory purposes and the gaming system may randomly generate any suitable combination of symbols based on defined symbol sets associated with the game reels 403*a*-403*c*.

FIG. 4A further illustrates the gaming system displaying the generated lock-in symbols 440*a*-440*c* in a first lock-in set of symbol display areas 430*a*-430*c* and the generated lock-in symbols 440*d*-440*f* in a second lock-in set of symbol display areas 430*d*-430*f* Lock-in symbols 440*a*-440*c* displayed on lock-in reel 404*a* illustrate the randomly generated lock-in symbols from the associated set of lock-in symbols after the lock-in reel has stopped spinning. As illustrated in FIG. 4A, the gaming system randomly generated and displayed lock-in symbols 440*a*, 440*b*, and 440*c* in lock-in symbol display areas 430*a*, 430*b*, and 430*c* for lock-in reel 404*a*. The gaming system generated and displayed an A symbol (440*a*), an F symbol (440*b*), and a G symbol (440*c*) in the game display 400. Lock-in symbols 440*d*-440*f* displayed on lock-in reel 404*b* illustrate the randomly generated lock-in symbols from the associated set of lock-in symbols after the lock-in reel has stopped spinning. As illustrated in FIG. 4A, the gaming system randomly generated and displayed lock-in symbols 440*d*, 440*e*, and 440*f* in lock-in symbol display areas 430*d*, 430*e*, and 430*f* for lock-in reel 404*b*. The gaming system generated and displayed a 3 symbol (440*d*), a 4 symbol (440*e*), and a 2 symbol (440*f*) in the game display 400. It should be appreciated that the displayed symbol combinations are merely for explanatory purposes and the gaming system may randomly generate any suitable combination of symbols based on defined symbol sets associated with the lock-in reels 404*a* and 404*b*.

FIG. 4A illustrates one embodiment of the gaming system that executed a first evaluation of the generated symbols on game reels 402*a*-402*c* for winning symbol combinations; a second evaluation of the generated symbols on game reels 403*a*-403*c* for winning symbol combinations; and a third combined evaluation of the generated symbols on game reels 402*a*-402*c* and 403*a*-403*c* for winning symbol combinations. The gaming system evaluated these generated symbols based on the example pay tables 500 listed in FIG. 5. For example, the generated symbols on game reels 402*a*-402*c* are evaluated against the left game pay table for winning symbol combinations; the second evaluation of the generated symbols on game reels 403*a*-403*c* are evaluated against the right game pay table for winning symbol combinations; and the third combined evaluation of the generated symbols on game reels 402*a*-402*c* and 403*a*-403*c* are evaluated against the combo game pay table for winning symbol combinations. However, any suitable pay tables can be used. As noted above, the player may have wagered on one or more pay lines (such as 10 pay lines shown in information area 405*h*). In one embodiment, at least the active (wagered on pay lines) are evaluated for winning symbol combinations. In some embodiments, all pay lines are evaluated for winning symbol combinations. In some embodiments, any suitable number of pay lines may be used to evaluate winning symbol combinations.

In the embodiment illustrated in FIG. 4A, the gaming system evaluated the generated symbol combinations for winning symbol combinations. In some embodiments, the first evaluation of game reels 402*a*-402*c* for winning symbol combinations occur starting from the symbols of the right most game reel 402*c* and move towards the game symbols on game reel 402*a*. In some embodiments, the second evaluation of game reels 403*a*-403*c* for winning symbol combinations occur starting from the symbols of the left most game reel 403*a* and move towards the game symbols on game reel 403*c*. In some embodiments, the gaming system also evaluates all of the generated game symbols (e.g., using a combination of all of the reels—except for the lock-in reels) for the third evaluation, where the evaluation may start from game reel 402*a* and move right towards game reel 403*c*. However, it should be appreciated that any suitable evaluation direction can be used. In some embodiments, fewer than all of the game reels are used in the third evaluation. In some embodiments, the lock-in reels can be used in the evaluation for winning symbol combinations.

In FIG. 4A, the gaming system determined that a winning symbol combination is displayed across one wagered pay line. The pay line spans across a horizontal direction of symbol display areas including symbol display areas 411*a*, 411*b*, and 411*c*. In this embodiment, the gaming system displayed three 3 symbols along a horizontal pay line on which the player had placed a wager. The gaming system determined the three 3 symbols form a winning symbol combination based on a pay table associated with the gaming system (such as the right side pay table in FIG. 5). The winning pay line is illustrated as pay line 424*a* in FIG. 4A across the row of game reels 403*a*-403*c*. The gaming system provides a 250 credit award for the three 3 symbols in accordance right side pay table in FIG. 5.

The gaming system may then determine if the player won any additional awards or award enhancements (hereafter collectively "award enhancements") based on the generated symbols on game reels 402*a*-402*c* and game reels 403*a*-403*c* and any award opportunity indicators. In FIG. 4A, the player did not have any preexisting award opportunity indicators displayed at the start of the play of the game, thus the gaming system determined that the player did not win any award enhancements.

The gaming system also determines if the gaming system should generate any award opportunity indicators in some embodiments. In one embodiment, the gaming system evaluates each row of the lock-in symbols in lock-in reel 404*a* against an associated row of game symbols of reels 402*a*-402*c*. For example, the gaming system evaluates the A symbol 440*a* in lock-in symbol display area 430*a* against the game symbols from the first row of reels 402*a*-402*c*. The gaming system may compare the A symbol 440*a* against the symbols 420*a*, 420*b*, and 420*c* to see if any of these symbols match with the A symbol 440*a*. As illustrated in FIG. 4A, the gaming system determines that game symbol 420*a* in symbol display area 410*a* matches with the lock-in symbol 440*a* of the lock-in reel 404*a*. As a result of such a match, the gaming system generates an award opportunity indicator 414 in the symbol display area 410*a*. In FIG. 4A, the award opportunity indicator 414 is shown as a box, but it can be any suitable mechanism to indicate to a player the existence of the award opportunity indicator 414 (as discussed above). In some embodiments, the award opportunity indicator 414 is also shown with a corresponding symbol (in this case the A symbol). This enables a player to know that the award opportunity indicator 414 in symbol display area 420*a* is associated with the A symbol. Thus, while the award opportunity indicator 414 is displayed in symbol display area 420*a* and the gaming system generates another A symbol, the gaming system may determine an award enhancement. It should be appreciated that the gaming system does not generate an award enhancement when symbols other than the A symbol are generated in symbol display area 420*a* (unless the symbol display area 420*a* includes other award opportunity indicator for other symbols). However, in some embodiments, the gaming system may be configured to generate an award enhancement when symbols other than the A symbol are generated in symbol display area 420*a* (e.g., the gaming system may associate the award opportunity indicator 414 with other symbols or more than one symbol). In some embodiments, generated the award opportunity indicators are persistent for a predetermined quantity of games (or plays of the game). For example, the predetermined quantity can be two plays of the game, five plays of the game, or some other suitable number. Thus, when the predetermined quantity is two plays, for each additional spin up to two spins, the award opportunity indicator 414 will continue to be displayed and enable the player to win an award enhancement when the gaming system generates another A symbol in symbol display area 420*a*. In some embodiments, the gaming system will remove the award opportunity indicator 414 once the gaming system generates another A symbol in symbol display area 420*a* while the award opportunity indicator 414 is displayed (e.g., during or after providing an award enhancement). In such an embodiment, the gaming system may remove the award opportunity indicator 414 before the predetermined quantity of plays of the game have been executed. As is also illustrated in FIG. 4A, the gaming system highlighted the lock-in A symbol 440*a* with box 413 to further indicate to the player that the lock-in symbol 440*a* helped create the award opportunity indicator 414.

The gaming system performs a similar process with the other lock-in symbols displayed in lock-in reel 404*a* against the game symbols in game reels 402*a*-402*c*. The gaming system also performs a similar process with the lock-in symbols displayed in lock-in reel 404*b* against the game symbols in game reels 403*a*-403*c*. As a result, the gaming system determined that three other game symbols in three other symbol display areas match with symbols in the lock-in reel 404*a* and lock-in reel 404*b*, respectively. For example, the lock-in F symbol 440*b* matched with the game F symbol 420*f* in the same row of both reels. As a result, the gaming system generated an award opportunity indicator 416 for the symbol display area 410*f*. The award opportunity indicator 416 is not only associated with the symbol display area 410*f*, the award opportunity indicator 416 is also associated with the F symbol. Like the award opportunity indicator 414, the gaming system generated a small F with the award opportunity indicator to illustrate that the award opportunity indicator 416 is associated with the F symbol. The gaming system also highlighted the lock-in F symbol 440*b* with box 412.

The lock-in 3 symbol 440*d* matched with the game 3 symbol 421*f* in the same row of both reels of the second set of game reels 403*a*-403*c*. As a result, the gaming system generated an award opportunity indicator 419 for the symbol display area 411*b*. The award opportunity indicator 419 is not only associated with the symbol display area 411*b*, the award opportunity indicator 419 is also associated with the 3 symbol. Like the award opportunity indicator 414, the gaming system generated a small 3 with the award opportunity indicator 419 to illustrate that the award opportunity indicator 419 is associated with the 3 symbol. The gaming system also highlighted the lock-in 3 symbol 440*d* with box 422. Similarly, the gaming system generated the award opportunity indicator 418 in symbol display area 421*g* for the matching lock-in 2 symbol 440*f* in reel 404*b* and highlighting box 423.

While FIG. 4A-4D are discussed in terms of matching lock-in symbols in the same substantially horizontal row as a row with game symbols, in some embodiments, lock-in symbols can be matched with game symbols in other suitable patterns or ways.

In some embodiments, the gaming system may accumulate award opportunity indicators in other areas of the game display in addition to the award opportunity indicators displayed in the symbol display areas. In some embodiments, the gaming system may generate a symbol in a blank symbol display area of a geometric shape (e.g., a rectangle or a pyramid) when the gaming system generates an award opportunity indicator for the symbol. In one embodiment, when the player completely fills the geometric shape, the gaming system evaluates the symbols accumulated in the geometric shape for winning symbol combinations and payouts any awards associated with the generated symbol combinations. In some embodiments, the gaming system removes accumulated symbols from the geometric shape that form winning symbol combinations, but leaves other symbols in the geometric shape that did not form winning symbol combinations. In this manner, the gaming system can attempt to replenish the geometric shape that is still partially filled. In some embodiments, after evaluating the geometric shape for winning symbol combinations, the gaming system removes all of the some from the geometric shape. In some embodiments, the geometric symbol combinations may have a plurality of different symbol fill levels. As the gaming system generates additional award opportunity indicators and begins to fill the geometric shape with associated symbols, the gaming system may issue different awards for how full the geometric shape is with symbols. In some embodiments, the gaming system associates three awards (e.g., a mini, minor, major award), that are each associated with the quantity of symbols that fill the geometric shape. The mini award can be associated with filling the geometric shape a quarter full with symbols. The minor award can be associated with filling the geometric shape half full with symbols. The major award can be associated with completely filling the geometric shape with symbols. It should be appreciated that any fill level can be used in connection with any suitable awards for the geometric shape.

Returning to FIG. 4A, the gaming system updated the player's win meter (shown in information area 405*d*) to reflect that the player has won the 250 credit award during the bonus game. The gaming system also updated the player's credit balance (shown in information area 405*c*) to reflect the prior 1980 credit balance updated with the additional 250 credit balance.

As can be appreciated, the initial game did not provide large pay outs. However, the gaming system generated numerous award opportunity indicators that can lead to award enhancements. With the prospect of large award enhancements associated with the generated award opportunity indicators, the player is encouraged to continue playing additional plays of the game. As previously discussed, the generated award opportunity indicators remain persistently displayed for at least two additional plays of the game, creating temporary award opportunity accumulations.

At the conclusion of the first play of the game, the player may continue the gaming session by playing another play of the game. That is, the player may place another wager and start a new play of the game, and keep any displayed persistent award opportunity indicators for at least the next play of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with award opportunity indicators remaining, the gaming system removes the award opportunity indicators so that a next player does not have access to the generated award opportunity indicators.

Figure 4B:
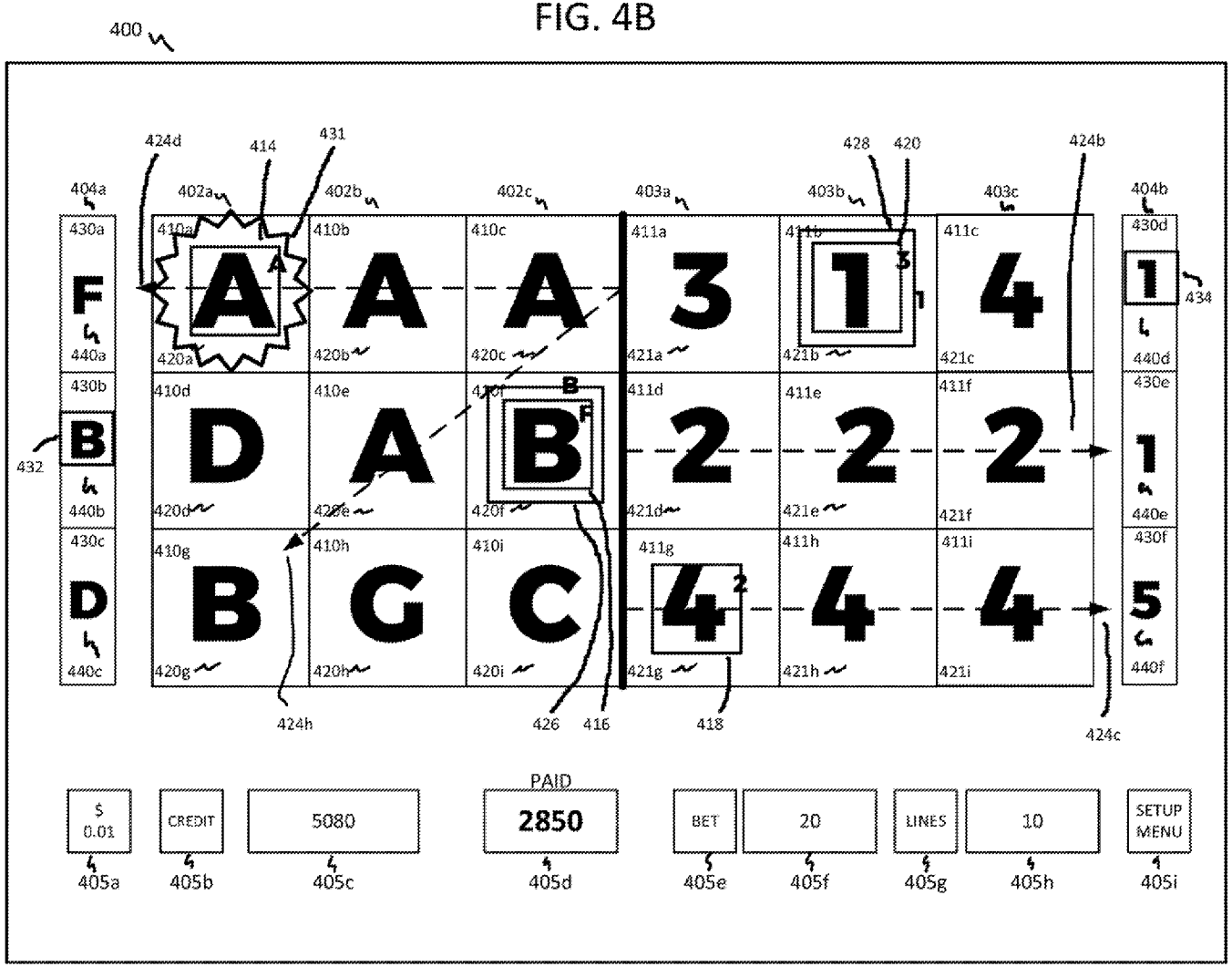

Turning to FIG. 4B, the gaming system generated another plurality of symbols for each set of game reels and for the lock-in reels, for another play of the game having temporary award opportunity accumulations. The gaming system replaced the previously displayed game symbols for each of the reels with the replacement generated symbols for the new play of the game. However, as illustrated in FIG. 4B, the gaming system also kept the award opportunity indicators generated in FIG. 4A.

FIG. 4B illustrates that the gaming system executed a first evaluation of the generated symbols on reels 402*a*-402*c* for winning symbol combinations; a second evaluation of the generated symbols on reels 403*a*-403*c* for winning symbol combinations; and a third combined evaluation of the generated symbols on reels 402*a*-402*c* and 403*a*-403*c* for winning symbol combinations. The gaming system evaluated these generated symbols based on the example pay tables 500 listed in FIG. 5. Like in FIG. 4A, the generated symbols on reels 402*a*-402*c* are evaluated against the left game pay table for winning symbol combinations; the second evaluation of the generated symbols on reels 403*a*-

403*c* are evaluated against the right game pay table for winning symbol combinations; and the third combined evaluation of the generated symbols on reels 402*a*-402*c* and 403*a*-403*c* are evaluated against the combo game pay table for winning symbol combinations.

In the embodiment illustrated in FIG. 4B, the gaming system evaluated the generated symbol combinations for winning symbol combinations in accordance with the evaluation directions discussed in connection in FIG. 4A.

In FIG. 4B, the gaming system determined that a winning symbol combination is displayed across four wagered pay lines. Two pay lines span across a horizontal direction and a diagonal direction of symbol display areas including symbol display areas 410*c*, 410*b*, and 410*a* and symbol display areas 410*c*, 410*e*, and 410*g*. Another two pay lines span across a horizontal direction of the second set of game reels. One such pay line spans across symbol display areas 411*d*, 411*e*, and 411*f* and the other pay line spans across symbol display area 411*g*, 411*h*, and 411*i*. The gaming system determined the three A symbols along pay line 424*d*, two A symbols along pay line 424*h*, three 2 symbols along pay line 424*b*, and three 4 symbols along pay line 424*c* form four separate winning symbol combinations based on the pay tables in FIG. 5. In accordance with FIG. 5, the gaming system determines that the player won 950 credits based on just the symbol combinations on wagered pay lines (e.g., 500+200+150+100).

Figure 6:
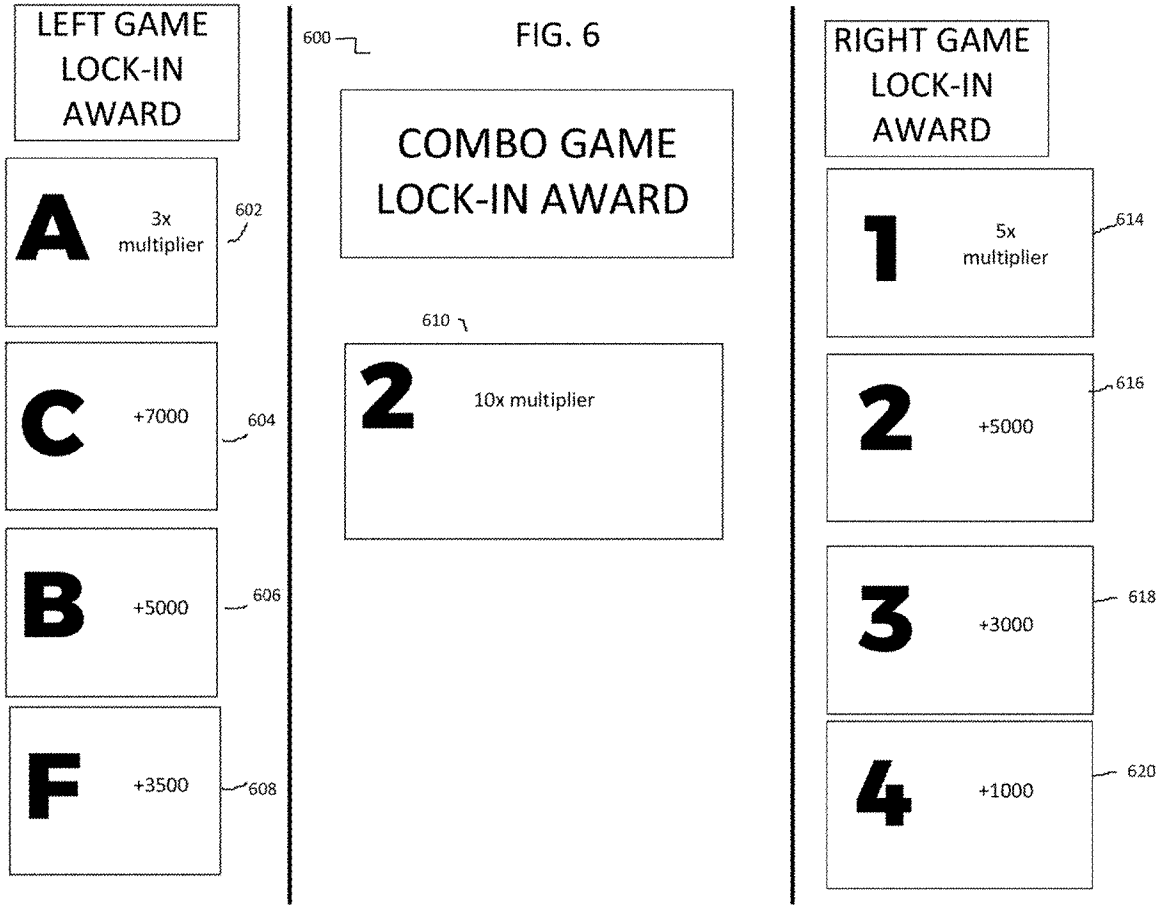

The gaming system may also determine if the player won any award enhancements based on the generated symbols on reels 402*a*-402*c* and reels 403*a*-403*c* and any award opportunity indicators. It should be appreciated that in some embodiments, the award enhancement determination can be performed before, during, or after the standard pay line awards are determined. In FIG. 4B, the gaming system determined that for one of the award opportunity indicators carried over from the prior play of the game, gaming system's generated replacement symbols produced an award enhancement. In particular, the gaming system determined that a new A symbol 420*a* was generated in symbol display area 410*a*. The symbol display area 410*a* displayed an award opportunity indicator 414 from a prior play of the game and the award opportunity indicator 414 is associated with an A symbol. Due to the match between the new A symbol 420*a* and the award opportunity indicator 414 being associated with an A symbol, the gaming system determined that the player won an award enhancement. The gaming system may highlight that the award opportunity indicator 414 resulted in an award enhancement, such as with the star shaped ring 431. However, the gaming system may generate any suitable mechanism to highlight that award opportunity indicator 414 resulted in an award enhancement in other embodiments. The gaming system may evaluate the award enhancement based on a pay table, such as the pay table illustrated in FIG. 6. FIG. 6 indicates that a lock-in award enhancement associated with an A symbol and the first set of game reels 402*a*-402*c* results in an award enhancement of a 3× multiplier. Thus, the gaming system may multiply the 950 credit standard award by the 3× multiplier to obtain a credit award of 2850 credits. The gaming system updated the player's win meter (shown in information area 405*d*) to reflect that the player won the 2850 credit award during the play of the game. The gaming system also updated the player's credit balance (shown in information area 405*c*) to reflect an addition of the new award for the play of the game.

In one embodiment, because the gaming system provided an award enhancement based on award opportunity indicator 414, the gaming system removes the award opportunity indicator 414. It should be appreciated that in some embodiments, the award opportunity indicator 414 can be kept persistently displayed for the two full additional plays of the game even if the award opportunity indicator 414 resulted in an enhanced award. While not shown in FIG. 4B, the award opportunity indicator 414 is removed and is not displayed in FIG. 4C.

The gaming system also determines if the gaming system should generate any new award opportunity indicators for the current play of the game. As discussed above, the gaming system may evaluate each row of the lock-in symbols in lock-in reel 404*a* against an associated row of game symbols of reels 402*a*-402*c* for symbol matches. The gaming system may also evaluate each row of the lock-in symbols in lock-in reel 404*b* against an associated row of game symbols of reels 403*a*-403*c* for symbol matches.

In FIG. 4B, the gaming system determined that the lock-in B symbol 440*b* in lock-in symbol display area 430*b* matched against the game B symbol 420*f* in the game symbol display area 410*f*. As a result of such a match, the gaming system generates an award opportunity indicator 426 in the symbol display area 410*f*. As illustrated in FIG. 4B, the gaming system generated the award opportunity indicator 426 in a symbol display area that already displayed the award opportunity indicator 416. Thus, this illustrates that the gaming system can generate more than one award opportunity indicator in a symbol display area. The gaming system also generated a small B with the award opportunity indicator 426 to enable the player to easily determine which symbols each of the award opportunity indicators were associated with. In some embodiments, the gaming system may alternative add the small B to the existing award opportunity indicator 416. Other suitable ways can be used to indicate that an award opportunity indicator associated with the B symbol is now associated with the symbol display area 410*f* When a symbol display area includes a plurality of award opportunity indicators, the player may now win award enhancements based on the gaming system generating either a B symbol or an F symbol in symbol display area 410*f* Thus, the gaming system with multiple award opportunity indicators provides the player with more opportunities to win award enhancements. Since the award opportunity indicator 426 was generated in a later play of the game than award opportunity indicator 416, the gaming system permits the award opportunity indicator 426 to remain displayed after the gaming system removes the award opportunity indicator 416 in later plays of the game. The gaming system also highlighted the lock-in B symbol 440*b* with box 432.

In FIG. 4B, the gaming system also determined that the lock-in 1 symbol 440*d* in lock-in symbol display area 430*d* matched against the game 1 symbol 421*b* in the game symbol display area 411*b*. As a result of such a match, the gaming system generates an award opportunity indicator 428 in the symbol display area 411*b*. As illustrated in FIG. 4B, the gaming system generated the award opportunity indicator 428 in a symbol display area that already display the award opportunity indicator 420. The gaming system also highlighted the lock-in 1 symbol 440*d* with box 434.

The gaming system may determine if any displayed award opportunity indicator has been displayed for two plays of the game. In the example of FIG. 4B, none of the displayed award opportunity indicators have been displayed for two plays of the game so the gaming system does not remove any of the award opportunity indicators.

At the conclusion of the second play of the game, the player may continue the gaming session by playing another play of the game. That is, the player may place another wager and start a new play of the game, and keep the persistent award opportunity indicators for the additional play of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with award opportunity indicators remaining, the gaming system removes the award opportunity indicators so that a next player does not have access to the existing generated award opportunity indicators.

Figure 4C:
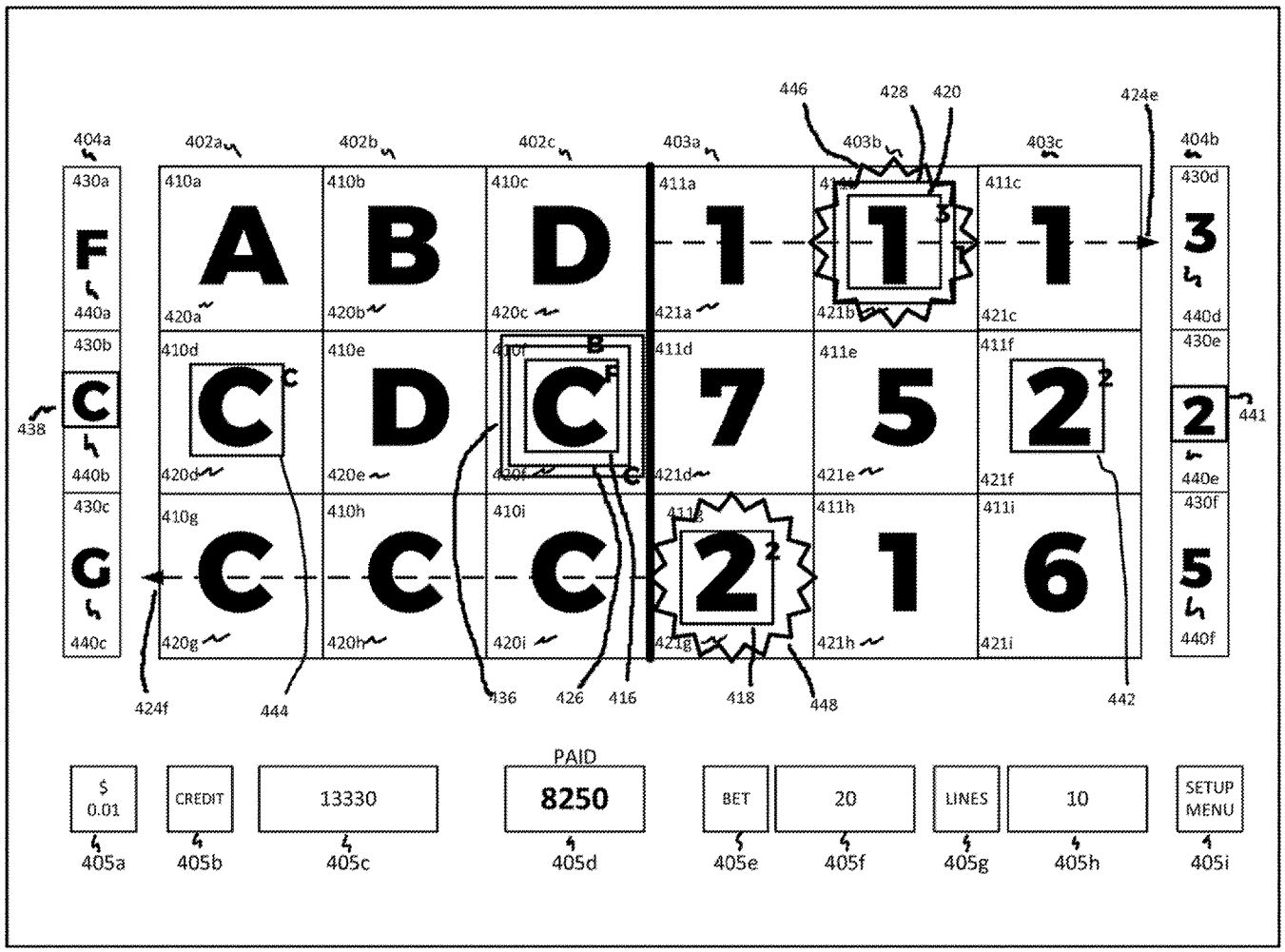

Turning to FIG. 4C, the gaming system generated another plurality of symbols for each set of game reels and for the lock-in reels, for another play of the game having temporary award opportunity accumulations. The gaming system replaced the previously displayed symbols for each of the reels with the replacement generated symbols for the new play of the game. However, as illustrated in FIG. 4C, the gaming system also kept some of the award opportunity indicators that were available in FIG. 4B. As discussed above, the gaming system removed the award opportunity indicator 414 displayed in FIG. 4B because the award opportunity indicator 414 resulted in an award enhancement.

FIG. 4C illustrates that the gaming system executed a first evaluation of the generated symbols on reels 402*a*-402*c* for winning symbol combinations; a second evaluation of the generated symbols on reels 403*a*-403*c* for winning symbol combinations; and a third combined evaluation of the generated symbols on reels 402*a*-402*c* and 403*a*-403*c* for winning symbol combinations. The gaming system evaluated these generated symbols based on the example pay tables 500 listed in FIG. 5. Like in FIG. 4A, the generated symbols on game reels 402*a*-402*c* are evaluated against the left game pay table for winning symbol combinations; the second evaluation of the generated symbols on game reels 403*a*-403*c* are evaluated against the right game pay table for winning symbol combinations; and the third combined evaluation of the generated symbols on game reels 402*a*-402*c* and 403*a*-403*c* are evaluated against the combo game pay table for winning symbol combinations. It should be appreciated that in some embodiments, the gaming system does not execute all three evaluations, where some of the evaluations are based on the size of the player's wager.

In the embodiment illustrated in FIG. 4C, the gaming system evaluated the generated symbol combinations for winning symbol combinations in accordance with the evaluation directions discussed in connection in FIG. 4A. The gaming system determined that a winning symbol combination is displayed across two wagered pay lines. One pay line spans across a horizontal direction of symbol display areas 410*i*, 410*h*, and 410*j*. Another pay line spans across symbol display areas 411*a*, 411*b*, and 411*c*. The gaming system determined that the three C symbols along pay line 424*f* and three 1 symbols along pay line 424*e* form two separate winning symbol combinations based on the pay tables in FIG. 5. The gaming system did not determine any winning symbol combination based on a combination of both sets of game reels. In accordance with FIG. 5, the gaming system determines that the player won 650 credits based on just the game symbols combinations on wagered pay lines (e.g., 350+300).

The gaming system may also determine if the player won any award enhancements based on the generated symbols on game reels 402*a*-402*c* and game reels 403*a*-403*c* and any award opportunity indicators. In FIG. 4C, the gaming system determined that for two of the award opportunity indicators carried over from a prior play of the game, gaming system's generated replacement symbols produced award enhancements. In particular, gaming system determined that a new 1 symbol 421*b* was generated in symbol display area 411*b*. The symbol display area 411*b* displayed an award opportunity indicator 428 from the prior play of the game and the award opportunity indicator 428 is associated with a 1 symbol. Because the 1 symbol 421*b* matches the 1 symbol associated with award opportunity indicator 428, the gaming system determined that the player won an award enhancement. The gaming system may highlight that the award opportunity indicator 428 resulted in an award enhancement, such as with the star shaped ring 446. The gaming system may evaluate the award enhancement based on a pay table, such as the pay table illustrated in FIG. 6. FIG. 6 indicates that a lock-in award enhancement associated with a 1 symbol and the second set of game reels 403*a*-403*c* results in an award enhancement of a 5× multiplier. Thus, the gaming system may multiply the 650 credit standard pay line award by the 5× multiplier to obtain a credit award of 3250 credits.

The gaming system also determined that a new 2 symbol 421*g* was generated in symbol display area 411*g*. The symbol display area 411*g* displayed an award opportunity indicator 418 from a prior play of the game and the award opportunity indicator 418 is associated with a 2 symbol. Because the 2 symbol 421*g* matches the 2 symbol associated with award opportunity indicator 418, the gaming system determined that the player won an award enhancement. The gaming system may highlight that the award opportunity indicator 418 resulted in an award enhancement, such as with the star shaped ring 448. The gaming system may evaluate the award enhancement based on a pay table, such as the pay table illustrated in FIG. 6. FIG. 6 indicates that a lock-in award enhancement associated with a 2 symbol and the second set of game reels 403*a*-403*c* results in an award enhancement of 5000 credits. Thus, the gaming system may add the 3250 credits previously determined to obtain a total credit award of 8250 credits for this play of the game.

It should be appreciated that the gaming system may calculate the awards determined in FIG. 4C in a different way, which could change the final credit award for this play of the game.

The gaming system updated the player's win meter (shown in information area 405*d*) to reflect that the player has won the 8250 credit award during the play of the game. The gaming system also updated the player's credit balance (shown in information area 405*c*) to reflect the new award for the play of the game.

The gaming system also determines if the gaming system should generate any new award opportunity indicators for the current play of the game. As discussed above, the gaming system may evaluate each row of the lock-in symbols in lock-in reel 404*a* against an associated row of game symbols of reels 402*a*-402*c* for symbol matches. The gaming system may also evaluate each row of the lock-in symbols in lock-in reel 404*b* against an associated row of game symbols of reels 403*a*-403*c* for symbol matches.

In some embodiments, the gaming system may determine and generate any new award opportunity indicators prior to determining any award enhancements. In some embodiments, the new award opportunity indicators can be use during the same play of the game to determine award enhancements as when the new award opportunity indicators were generated.

In FIG. 4C, the gaming system determined that the lock-in C symbol 440*b* in lock-in symbol display area 430*b* matched against the game C symbol 420*f* in the game symbol display area 410*f* and matched against the game C symbol 420*d* in the game symbol display area 410*d*. As a result of such matches, the gaming system generated an award opportunity indicator 436 in the symbol display area 410*f* and an award opportunity indicator 444 in symbol display area 410*d*. As illustrated in FIG. 4C, the gaming system generated the award opportunity indicator 436 in a symbol display area that already displayed the award opportunity indicator 416 and award opportunity indicator 426. Thus, this illustrates that the gaming system can generate more than two award opportunity indicators in a given symbol display area and for different associated symbols. The gaming system also generated a small C with the award opportunity indicator 436 and with the award opportunity indicator 444 to enable the player to easily determine which symbols each of the award opportunity indicators were associated with. Since the award opportunity indicator 436 was generated in a later play of the game than award opportunity indicators 416 and 426, the gaming system permits the award opportunity indicator 436 to remain displayed after the gaming system removes the award opportunity indicator 416 and 426 in later plays of the game. The gaming system also highlighted the lock-in C symbol 440*b* with box 438.

In FIG. 4C, the gaming system also determined that the lock-in 2 symbol 440*e* in lock-in symbol display area 430*e* matched against the game 2 symbol 421*f* in the game symbol display area 411*f*. As a result of such a match, the gaming system generates an award opportunity indicator 442 in the symbol display area 411*f*. The gaming system also highlighted the lock-in 2 symbol 440*f* with box 441.

The gaming system may determine if any displayed award opportunity indicator has been displayed for two plays of the game for purposes of removing such award opportunity indicators. In the example of FIG. 4C, three of the displayed award opportunity indicators have been displayed for two plays of the game so the gaming system removes these award opportunity indicators for the next play of the game (illustrated in FIG. 4D).

At the conclusion of the third play of the game, the player may continue the gaming session by playing another play of the game. That is, the player may place another wager and start a new play of the game, and keep the persistent award opportunity indicators for additional plays of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses to cash out with award opportunity indicators remaining, the gaming system removes the award opportunity indicators so that a next player does not have access to the generated award opportunity indicators.

Figure 4D:
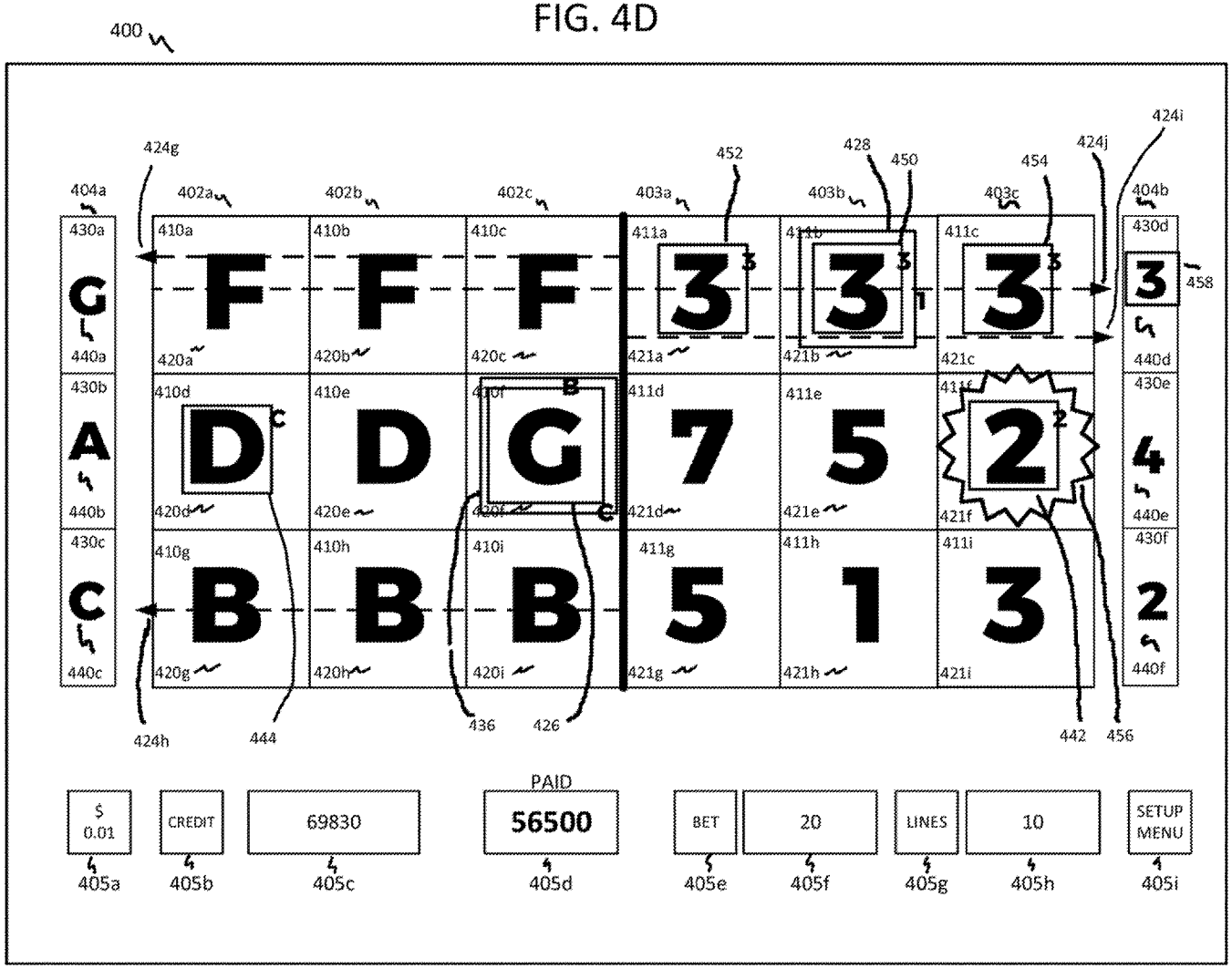

Turning to FIG. 4D, the gaming system generated another plurality of symbols for each set of game reels and for the lock-in reels, for another play of the game having temporary award opportunity accumulations. The gaming system replaced the previously displayed symbols for each of the reels with the replacement generated symbols for the new play of the game. As also illustrated in FIG. 4D, the gaming system kept some of the award opportunity indicators that were available in FIG. 4C. The gaming system removed award opportunity indicator 416, award opportunity indicator 418, and award opportunity indicator 420 because these three award opportunity indicators had been displayed for two plays of the game.

FIG. 4D illustrates that the gaming system executed a first evaluation of the generated symbols on game reels 402*a*-402*c* for winning symbol combinations; a second evaluation of the generated symbols on game reels 403*a*-403*c* for winning symbol combinations; and a third combined evaluation of the generated symbols on game reels 402*a*-402*c* and 403*a*-403*c* for winning symbol combinations. The gaming system evaluated these generated symbols based on the example pay tables 500 listed in FIG. 5. Like in FIG. 4A, the generated symbols on game reels 402*a*-402*c* are evaluated against the left game pay table for winning symbol combinations; the second evaluation of the generated symbols on game reels 403*a*-403*c* are evaluated against the right game pay table for winning symbol combinations; and the third combined evaluation of the generated symbols on game reels 402*a*-402*c* and 403*a*-403*c* are evaluated against the combo game pay table for winning symbol combinations. It should be appreciated that in some embodiments, the gaming system does not execute all three evaluations, where some of the evaluations are based on the size of the player's wager.

In the embodiment illustrated in FIG. 4D, the gaming system evaluated the generated symbol combinations for winning symbol combinations in accordance with the evaluation directions discussed in connection in FIG. 4A. The gaming system determined that a winning symbol combination is displayed across four wagered pay lines. One pay line spans across a horizontal direction of symbol display areas 410*i*, 410*h*, and 410*j*. A second pay line spans across a horizontal direction of symbol display areas 410*c*, 410*b*, and 410*a*. A third pay line spans across symbol display areas 411*a*, 411*b*, and 411*c*. A fourth pay line spans across symbol display areas 410*a*, 410*b*, 410*c*, 411*a*, 411*b*, and 411*c*. The gaming system determined the three F symbols along pay line 424*g*, three B symbols along pay line 424*h*, three 3 symbols along pay line 424*i*, and the combination of three F symbols and three 3 symbols along pay line 424*j* form four separate winning symbol combinations based on the pay tables in FIG. 5. In accordance with FIG. 5, the gaming system determines that the player won 5650 credits based on just the symbol combinations on wagered pay lines (e.g., 100+300+250+5000 credits).

The gaming system may also determine if the player won any award enhancements based on the generated symbols on game reels 402*a*-402*c* and game reels 403*a*-403*c* and any award opportunity indicators. In FIG. 4D, the gaming system determined that for one of the award opportunity indicators carried over from a prior play of the game, gaming system's generated replacement symbols produced an award enhancement. In particular, gaming system determined that a new 2 symbol 421*f* was generated in symbol display area 411*f*. The symbol display area 411*f* displayed an award opportunity indicator 442 from the prior play of the game and the award opportunity indicator 442 is associated with a 2 symbol. Because the 2 symbol 421*f* matches the 2 symbol associated with award opportunity indicator 442, the gaming system determined that the player won an award enhancement. The gaming system may highlight that the award opportunity indicator 442 resulted in an award enhancement, such as with the star shaped ring 456. The gaming system may evaluate the award enhancement based on a pay table, such as the pay table illustrated in FIG. 6. FIG. 6 indicates that a lock-in award enhancement associated with a 2 symbol and the second set of game reels

403*a*-403*c* results in an award enhancement of 5000 credits. However, because the gaming system also generated an award based on the combination of the first set of game reels 402*a*-402*c* and the second set of game reels 403*a*-403*c*, the gaming system uses the combo game lock-in award enhancement to determine the player's award enhancement. Thus, the gaming system may multiply the 5650 credit standard pay line award by the 10× multiplier to obtain a credit award of 56500 credits. In some embodiments, the gaming system may provide the player both award enhancements.

The gaming system updated the player's win meter (shown in information area 405*d*) to reflect that the player has won the 56500 credit award during the play of the game. The gaming system also updated the player's credit balance (shown in information area 405*c*) to reflect the addition of the new award for the play of the game.

The gaming system also determines if the gaming system should generate any new award opportunity indicators for the current play of the game. As discussed above, the gaming system may evaluate each row of the lock-in symbols in lock-in reel 404*a* against an associated row of game symbols of game reels 402*a*-402*c* for symbol matches. The gaming system may also evaluate each row of the lock-in symbols in lock-in reel 404*b* against an associated row of game symbols of game reels 403*a*-403*c* for symbol matches.

In FIG. 4D, the gaming system determined that the lock-in 3 symbol 440*d* in lock-in symbol display area 430*d* matched against the game 3 symbols 421*a*, 421*b*, and 421*c* in the respective game symbol display areas 411*a*, 411*b*, and 411*c*. As a result of such matches, the gaming system generated new award opportunity indicators 452, 450, and 454 in the symbol display areas 411*a*, 411*b*, and 411*c*. As illustrated in FIG. 4D, the gaming system generated the award opportunity indicator 450 in a symbol display area that already displayed the award opportunity indicator 428. The gaming system also generated a small 3 with the award opportunity indicators 450, 452, and 454 to enable the player to easily determine which symbols each of the award opportunity indicators were associated with. The gaming system also highlighted the lock-in 3 symbol 440*d* with box 458.

The gaming system may determine if any displayed award opportunity indicator has been displayed for two plays of the game for purposes of removing such award opportunity indicators. In the example of FIG. 4D, two of the displayed award opportunity indicators 426 and 428 have been displayed for two plays of the game so the gaming system will remove these award opportunity indicators for the next play of the game.

At the conclusion of the fourth play of the game, the player may continue the gaming session by playing another play of the game. That is, the player may place another wager and start a new play of the game, and keep the persistent award opportunity indicators for additional plays of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with award opportunity indicators remaining, the gaming system removes the award opportunity indicators so that a next player does not have access to the generated award opportunity indicators.

Figure 5:
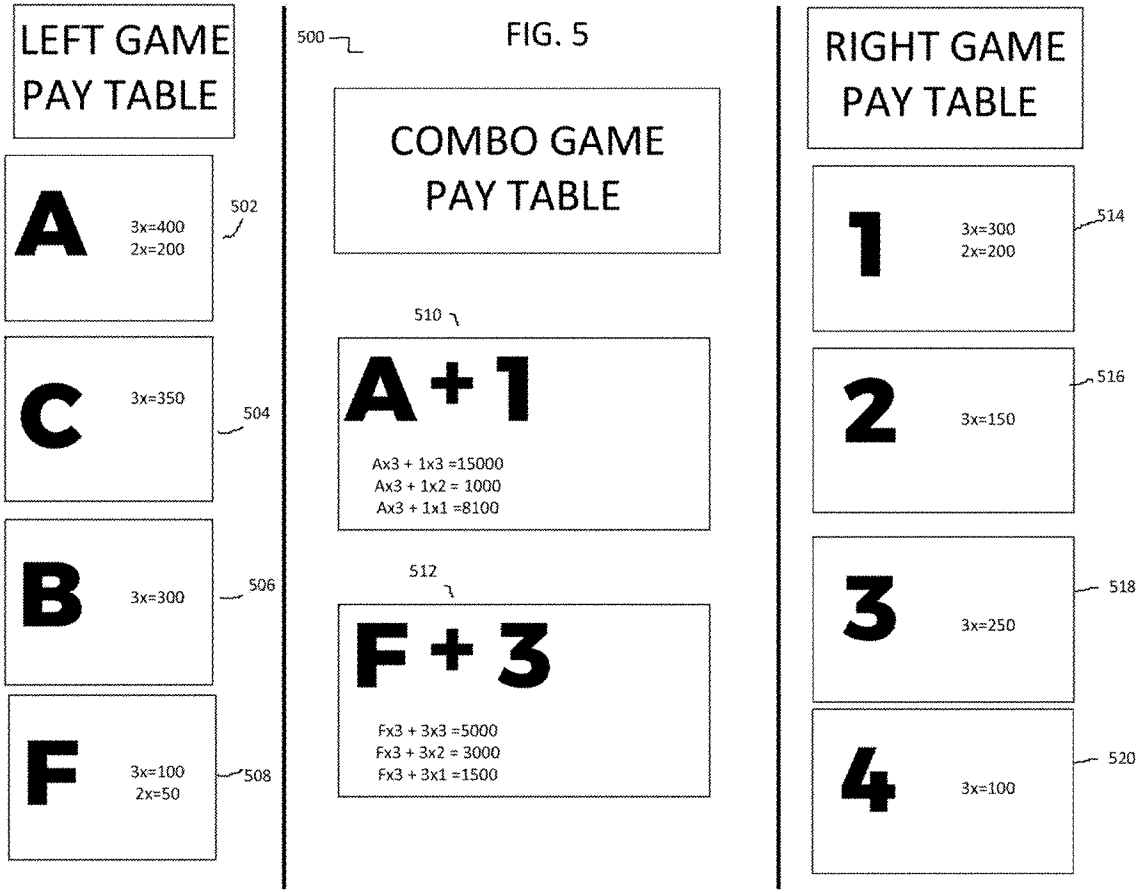
FIG. 5 and FIG. 6 illustrate embodiments of pay tables in a gaming system having award enhancements based on one or more temporary award opportunity accumulations.

FIG. 5 illustrates a screen shot of one embodiment of a pay table 500 for a game of the gaming system. Tables 502, 504, 506, 508, 510, 512, 514, 516, 518, and 520 are merely example payout awards for example symbol combinations for different sets of game reels. As noted above, it should be appreciated that the pay tables are merely illustrative, and the symbols, awards, and the credit values may all be modified in any suitable manner.

FIG. 6 illustrates a screen shot of one embodiment of a pay table for award enhancements that stem from award opportunity indicators and lock-in symbols of the gaming system. As noted above, it should be appreciated that the pay table is merely illustrative, and the symbols, awards, and the credit values may all be modified in any suitable manner.

By enabling the player to accumulate temporary award opportunities for future plays of a game and combining these accumulated temporary award opportunities with standard awards, the gaming system offers players new ways to obtain game awards and enhances players' excitement for a game. Moreover, by combining a first accumulating temporary award opportunity game with a second accumulating temporary award opportunity game, the gaming system offers players even greater new ways to obtain game awards. The new potential to improve or earn greater awards creates a greatly improved sense of anticipation for players.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager;

randomly generate a plurality of game symbols for a game set of symbol display areas and a plurality of lock-in symbols for a lock-in set of symbol display areas, the lock-in set of symbol display areas being associated with the game set of symbol display areas;

display, on the display device, the plurality of game symbols in the game set of symbol display areas and the plurality of lock-in symbols in the lock-in set of symbol display areas;

determine whether a generated game symbol of the plurality of game symbols matches at least one of the plurality of lock-in symbols;

when the generated game symbol matches the at least one of the plurality of lock-in symbols, generate an indicator associated with a symbol display area of the game set of symbol display areas that displays the matching generated game symbol, wherein the indicator is also associated with the matching generated game symbol;

randomly generate a plurality of replacement game symbols for the game set of symbol display areas;

display, on the display device, the plurality of replacement game symbols in the game set of symbol display areas;

determine whether a replacement game symbol of the plurality of replacement game symbols displayed in the symbol display area associated with the indicator matches the matching generated game symbol associated with the indicator;

determine awards when the processor determines that the replacement game symbol matches the matching generated game symbol associated with the indicator;

display, on the display device, the determined awards, the credit balance being increased by any determined awards; and issue value from the value dispenser based on the credit balance upon receipt of a cash out request.

2. The gaming system of claim 1, wherein the game set of symbol display areas is associated with a plurality of game reels and the lock-in set of symbol display areas is associated with a lock-in reel.

3. The gaming system of claim 2, wherein determining whether the generated game symbol matches with the at least one of the plurality of lock-in symbols comprises:

determining whether the generated game symbol and the at least one of the plurality of lock-in symbols are displayed in a same row of the plurality of game reels and the lock-in reel.

4. The gaming system of claim 1, wherein the indicator associated with the symbol display area of the game set of symbol display areas that displays the matching generated game symbol is stored in the memory device for a predetermined quantity of additional random generations of a plurality of replacement game symbols.

5. The gaming system of claim 1, wherein:

the processor further determines whether a plurality of the generated game symbols match with any of the plurality of lock-in symbols;

for each determined match between the plurality of generated game symbols and the plurality of lock-in symbols, generate a new indicator associated with an additional symbol display area of the game set of symbol display areas that displays the additional matching game symbol; and the new indicator is also associated with the additional matching game symbol.

6. The gaming system of claim 1, wherein the processor further:

generates and displays a plurality of replacement lock-in symbols;

determines whether a generated replacement game symbol matches at least one of the plurality of replacement lock-in symbols;

for the matches determined between the generated replacement symbol and the at least one of the plurality of replacement lock-in symbols, generate a second indicator associated a symbol display area of the game set of symbol display areas that displays the matching replacement game symbol, wherein the indicator is also associated with the matching replacement game symbol.

7. The gaming system of claim 6, wherein the symbol display area of the game set of symbol display areas that displays the matching replacement game symbol is the same symbol display area of the game set of symbol display areas that displayed the matching game symbol.

8. The gaming system of claim 7, wherein the indicator associated with the symbol display area and the second indicator associated with the symbol display area simultaneously remain associated with the symbol display area while the processor further randomly generates a second plurality of replacement game symbols for the game set of symbol display areas.

9. The gaming system of claim 6, wherein the processor removes the indicator prior to removing the second indicator.

10. The gaming system of claim 1, wherein the processor further determines additional awards based on the plurality of game symbols in the game set of symbol display areas independent of the plurality of lock-in symbols in the lock-in set of symbol display areas and prior to randomly generating the plurality of replacement game symbols.

11. The gaming system of claim 1, wherein the processor further removes the indicator associated with the symbol display area of the game set of symbol display areas when the processor determines to provide an additional award based on the match between the replacement game symbol and the matching game symbol associated with the indicator.

12. The gaming system of claim 1, wherein the processor further determines if the wager is equal to or greater than a predetermined threshold quantity before determining the awards based on the match between the replacement game symbol and the matching game symbol associated with the indicator.

13. The gaming system of claim 1, wherein the processor further:

randomly generates a plurality of second game symbols for a second game set of symbol display areas and a second plurality of lock-in symbols for a second lock-in set of symbol display areas, the second lock-in set of symbol display areas being associated with the second game set of symbol display areas;

displays, on the display device, the plurality of second game symbols in the second game set of symbol display areas and the second plurality of lock-in symbols in the second lock-in set of symbol display areas;

determines whether a generated second game symbol matches at least one of the second plurality of lock-in symbols;

when the generated second game symbol matches the at least one of the second plurality of lock-in symbols, generates a second indicator associated with a second symbol display area of the second game set of symbol display areas that displays the matching second game symbol, wherein the indicator is also associated with the matching second game symbol;

randomly generates a plurality of second replacement game symbols for the second game set of symbol display areas;

displays, on the display device, the plurality of second replacement game symbols in the second game set of symbol display areas;

determines whether a second replacement game symbol displayed in the second symbol display area associated with the second indicator matches the matching second game symbol associated with the second indicator; and determines second awards when the processor determines that the second replacement game symbol matches the matching second game symbol associated with the second indicator.

14. The gaming system of claim 13, wherein the plurality of second game symbols for the second game set of symbol display areas and the second plurality of lock-in symbols for the second lock-in set of symbol display areas are different from the plurality of game symbols for the game set of symbol display areas and the plurality of lock-in symbols for the lock-in set of symbol display areas.

15. The gaming system of claim 13, wherein the game set of symbol display areas and the second game set of symbol display areas are aligned.

16. The gaming system of claim 15, wherein the processor further:

determines third awards based on the plurality of game symbols in the game set of symbol display areas independent of the plurality of lock-in symbols in the lock-in set of symbol display areas and prior to randomly generating the plurality of replacement game symbols; and determines fourth awards based on the plurality of second game symbols in the second game set of symbol display areas independent of the second plurality of lock-in symbols in the second lock-in set of symbol display areas and prior to randomly generating the plurality of second replacement game symbols.

17. The gaming system of claim 16, wherein:

when determining the awards based on the plurality of game symbols in the game set of symbol display areas, the processor evaluates the plurality of game symbols from right to left; and when determining the third awards based on the plurality of second game symbols in the second game set of symbol display areas, the processor evaluates the plurality of second game symbols from left to right.

18. The gaming system of claim 1, wherein the processor further determines additional awards based on a combination of the plurality of game symbols in the game set of symbol display areas and the plurality of second game symbols in the second game set of symbol display areas.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

randomly generating a plurality of game symbols for a game set of symbol display areas and a plurality of lock-in symbols for a lock-in set of symbol display areas, the lock-in set of symbol display areas being associated with the game set of symbol display areas;

displaying, on the display device of the housing, the plurality of game symbols in the game set of symbol display areas and the plurality of lock-in symbols in the lock-in set of symbol display areas;

determining whether a generated game symbol of the plurality of game symbols matches at least one of the plurality of lock-in symbols;

when the generated game symbol matches the at least one of the plurality of lock-in symbols, generating an indicator associated with a symbol display area of the game set of symbol display areas that displays the matching generated game symbol, wherein the indicator is also associated with the matching generated game symbol;

randomly generating a plurality of replacement game symbols for the game set of symbol display areas;

displaying, on the display device, the plurality of replacement game symbols in the game set of symbol display areas;

determining whether a replacement game symbol of the plurality of replacement game symbols displayed in the symbol display area associated with the indicator matches the matching generated game symbol associated with the indicator;

determining awards when the processor determines that the replacement game symbol matches the matching generated game symbol associated with the indicator;

displaying, on the display device, the of the determined awards;

increasing, by the processor, the credit balance by the determined awards; and issuing another monetary value, by a value dispenser, based on the credit balance upon receipt of a cash out request.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

randomly generate a plurality of game symbols for a game set of symbol display areas and a plurality of lock-in symbols for a lock-in set of symbol display areas, the lock-in set of symbol display areas being associated with the game set of symbol display areas;

display, on a display device, the plurality of game symbols in the game set of symbol display areas and the plurality of lock-in symbols in the lock-in set of symbol display areas;

determine whether a generated game symbol of the plurality of game symbols matches at least one of the plurality of lock-in symbols;

when the generated game symbol matches the at least one of the plurality of lock-in symbols, generate an indicator associated with a symbol display area of the game set of symbol display areas that displays the matching generated game symbol, wherein the indicator is also associated with the matching generated game symbol;

randomly generate a plurality of replacement game symbols for the game set of symbol display areas;

display, on the display device, the plurality of replacement game symbols in the game set of symbol display areas;

determine whether a replacement game symbol of the plurality of replacement game symbols displayed in the symbol display area associated with the indicator matches the matching generated game symbol associated with the indicator;

determine awards when the processor determines that the replacement game symbol matches the matching generated game symbol associated with the indicator;

display, on the display device, the determined awards;

increase the credit balance by the determined awards; and issue value, from a value dispenser, based on the credit balance upon receipt of a cash out request.

* * * * *